US010837232B2

(12) United States Patent
Borgen

(10) Patent No.: US 10,837,232 B2
(45) Date of Patent: Nov. 17, 2020

(54) HYDRAULIC MOTOR FOR A DRILLING SYSTEM

(71) Applicant: Hawle Water Technology Norge AS, Skui (NO)

(72) Inventor: Harald Borgen, Horten (NO)

(73) Assignee: Hawle Water Technology Norge AS, Skui (NO)

( * ) Notice: Subject to any disclaimer, the term of this patent is extended or adjusted under 35 U.S.C. 154(b) by 106 days.

(21) Appl. No.: 16/091,113

(22) PCT Filed: Apr. 3, 2017

(86) PCT No.: PCT/EP2017/057810
§ 371 (c)(1),
(2) Date: Oct. 4, 2018

(87) PCT Pub. No.: WO2017/174483
PCT Pub. Date: Oct. 12, 2017

(65) Prior Publication Data

US 2019/0195021 A1 Jun. 27, 2019

(30) Foreign Application Priority Data

Apr. 6, 2016 (EP) ..... 16164115

(51) Int. Cl.
*E21B 4/02* (2006.01)
*E21B 7/04* (2006.01)
(Continued)

(52) U.S. Cl.
CPC ..... *E21B 4/02* (2013.01); *E21B 4/006* (2013.01); *E21B 7/046* (2013.01); *E21B 7/067* (2013.01);
(Continued)

(58) Field of Classification Search
CPC ..... E21B 4/02; E21B 4/006
See application file for complete search history.

(56) References Cited

U.S. PATENT DOCUMENTS 2,660,402 A * 11/1953 Devine ..... E21B 4/02 175/107
6,474,932 B1 * 11/2002 Rush ..... E21B 19/15 414/745.7

(Continued)

FOREIGN PATENT DOCUMENTS

WO WO 99/20904 4/1999

OTHER PUBLICATIONS

European Search Report and the European Search Opinion dated Nov. 3, 2016 From the European Patent Office Re. Application No. 16164115.4. (7 Pages).

*Primary Examiner* — Tara Schimpf

(57) ABSTRACT

The invention relates to a hydraulic motor (2), comprising a cylindrical motor housing (201) with a central cylindrical rotor (202) carrying longitudinal vanes (208), wherein the vanes (208) are provided at the outer surface of the rotor (202) in such a manner that they can protrude into an annular space between the housing (201) and the rotor (202) in order to create a circumferential driving force on the rotor, wherein the housing (201) comprises inwards pointing salient cams (210) on its inner surface, which separate the annular space between the housing (201) and the rotor (202) into several hydraulic chambers (211) with at least one inlet (212) and at least one outlet (213) for a hydraulic medium, and the vanes (208) can swing around a longitudinal axis that is mostly parallel to the rotation axis of the rotor (202) into the hydraulic chambers (211). The invention further relates to the use of such a hydraulic motor in a drilling system, and a drilling system with such a hydraulic motor.

14 Claims, 23 Drawing Sheets

(51) Int. Cl.

| | |
|---|---|
| ***E21B 7/06*** | (2006.01) |
| ***F03B 13/02*** | (2006.01) |
| ***E21B 4/00*** | (2006.01) |
| *E21B 10/32* | (2006.01) |

(52) U.S. Cl.
CPC ..... *E21B 7/068* (2013.01); *F03B 13/02* (2013.01); *E21B 10/32* (2013.01)

(56) References Cited

U.S. PATENT DOCUMENTS

| | | | | |
|---|---|---|---|---|
| 7,172,039 | B2 * | 2/2007 | Teale | E21B 4/02 175/100 |
| 8,931,558 | B1 | 1/2015 | Harper | |
| 2008/0264692 | A1 * | 10/2008 | Underwood | E21B 4/02 175/106 |
| 2018/0274299 | A1 * | 9/2018 | Strange | E21B 21/00 |

* cited by examiner

A-A

HYDRAULIC MOTOR FOR A DRILLING SYSTEM

RELATED APPLICATIONS

This application is a National Phase of PCT Patent Application No. PCT/EP2017/057810 having International filing date of Apr. 3, 2017, which claims the benefit of priority of European Patent Application No. 16164115.4 filed on Apr. 6, 2016. The contents of the above applications are all incorporated by reference as if fully set forth herein in their entirety.

FIELD AND BACKGROUND OF THE INVENTION

The invention relates to a hydraulic motor, particularly to a hydraulic motor for a steerable drilling system, and a steerable drilling system comprising such a hydraulic motor.

Horizontal drilling devices are used to introduce supply and disposal lines into the ground in trenchless construction or to exchange already installed lines in a trenchless manner. Common are horizontal drilling devices in which a drill head is initially advanced into the ground by means of a drill rod assembly, and is later redirected into a horizontal position. The target point for such a horizontal drilling can be located under ground level, for example in an excavation pit, a maintenance shaft of a sewage line, or in the basement of a house. Alternatively, the drill head might be redirected into a vertical direction to let it reemerge above ground. After the drill head has reached the target point, it is often replaced by a widening device such as a conical widening body to widen the previously generated bore or to completely remove an already installed conduit.

A problem of existing steerable drilling systems is, that these are propelled through the ground either by rotating the drill head, or by pushing the drill head, for example using a hammer or stroke device. The forward thrust is usually provided to the drill head over the drill string from outside of the drilled hole, which might be problematic due to limited space in horizontal drilling applications. A further problem of existing drilling systems is, that the torque lock for systems based on a drilling head, which creates strong torque on the drill string, is usually achieved by mechanical means, which are often not easy to handle. A further problem of existing drilling systems is, that in order to allow the steering of the drill head, such systems comprise asymmetrically shaped drill heads, which are for example slanted. Such drill heads will be laterally deflected into the desired direction when pushed forward without rotation. When the drill head is rotated, the asymmetric configuration has no influence on the straight drilling course. However, propulsion by means of hammering requires a stiff drill string in order to transfer the force onto the drill head, which therefore limits the bending radius of the drilled bore.

A further problem of existing drilling systems is, that the driving motor of the drill head is usually arranged outside of the drilled hole, so that the drill force is transferred over a drill string to the drill head. However, this makes the drilling of small radii difficult or impossible. A further problem of existing drilling systems is, that the drilled hole might not be stable enough to easily insert a tubular member, such as a commonly used protection pipe, into the drilled hole. If the tubular member such as a protection pipe is pulled by the drill head assembly into the drilled hole, the problem arises, that the protection pipe is subject to heavy mechanical abrasion and shearing. A further problem of existing drilling systems is, that commonly used hydraulic motors to drive the drill head involve the deliberate offset of the rotational center of the rotor with respect to the geometrical center of the outer case, where vanes move radially out from the rotational center of the rotor. This causes several problems. First, the pressure unbalance caused by the hydraulic-based force on the radial cross-section of the rotor and vanes at the axis viewed from the radial perspective severely limits the power capability and power density of these pumps and results in heavy, inefficient, and cumbersome devices. Second, the centrifugal force of each vane during high speed rotation causes severe wear of the vane outer edge and the inner surface of the outer containment housing.

SUMMARY OF THE INVENTION

It is an object of the invention to solve these problems and propose improvements in different aspects of drilling systems, which are particularly useful for, but not limited to, horizontal steerable drilling systems. It is a further object of the invention to propose a steerable drilling system comprising all or any of the proposed improvements.

These and other problems are solved by a hydraulic motor comprising a cylindrical motor housing with a central cylindrical rotor carrying longitudinal vanes, wherein the vanes are provided at the outer surface of the rotor in such a manner that they can protrude into an annular space between the housing and the rotor in order to create a circumferential driving force on the rotor, and wherein the housing comprises inwards pointing salient cams on its inner surface, which separate the annular space between the housing and the rotor into several hydraulic chambers with at least one inlet and at least one outlet for a hydraulic medium, and wherein the vanes can move around a longitudinal axis that is mostly parallel to the rotation axis of the rotor into the hydraulic chambers.

According to a further aspect of the invention, the inlet and the outlet are provided directly adjacent to each salient cam and on opposite ends of the chamber, so that in any position of the rotor, there is at least one vane provided between the inlet and outlet of a chamber in such a way that a vane works as a piston within the hydraulic chamber.

According to a further aspect of the invention, elastic elements such as springs are provided between the outer surface of the rotor and each vane to move or swing the vanes around their axis in radial direction outwards towards the housing.

According to a further aspect of the invention, the number of vanes is higher than the number of salient cams. According to a further aspect of the invention, the number of salient cams is two or more.

According to a further aspect of the invention, the elastic elements are provided in pressure compensation chambers which are connected to the outer surface of the rotor by compensation vents in such a way that the radial movement of the vanes is compensated with respect to the pressure difference between the inlet port and the outlet port, so that the radial force on the vanes is mainly provided by the elastic elements.

According to a further aspect of the invention, the vanes are provided with a curved face at their rim so that, when they are folded into the rotor, their outer surface is substantially even with the outer cylindrical surface of the rotor.

According to a further aspect of the invention, a mechanical stop is provided at the vane which interacts with the outer surface of the rotor in such a way, that the vanes are prevented from touching the wall of the housing.

BRIEF DESCRIPTION OF THE SEVERAL VIEWS OF THE DRAWINGS

FIG. 3*g* shows a schematic representation of the port plate;

According to a further aspect of the invention, longitudinal grooves or tracks are provided on the outer end of the vanes, which are substantially parallel to the rotation axis of the rotor in order to provide a flow resistance against medium leakage.

According to a further aspect of the invention, the rotor is hollow and comprises a substantially central opening.

The invention further relates to using the hydraulic motor according to the invention for a drilling system, particularly for a steerable drilling system.

The invention further relates to drilling systems, particularly steerable drilling systems, comprising a hydraulic motor according to the invention. The invention further relates to drilling system, particularly steerable drilling systems, further comprising a protection sleeve, a directional steering joint, a counter hold system, a drill head with a crushing system, and/or a magnetic propulsion system as outlined below.

Further aspects of the invention are described in the claims, the figures and the description of the embodiments. The following description of non-limiting embodiments details several independent aspects of a proposed drilling system with a hydraulic motor according to the invention. However, the invention is not limited to the proposed embodiments.

DESCRIPTION OF SPECIFIC EMBODIMENTS OF THE INVENTION

Figure 1:
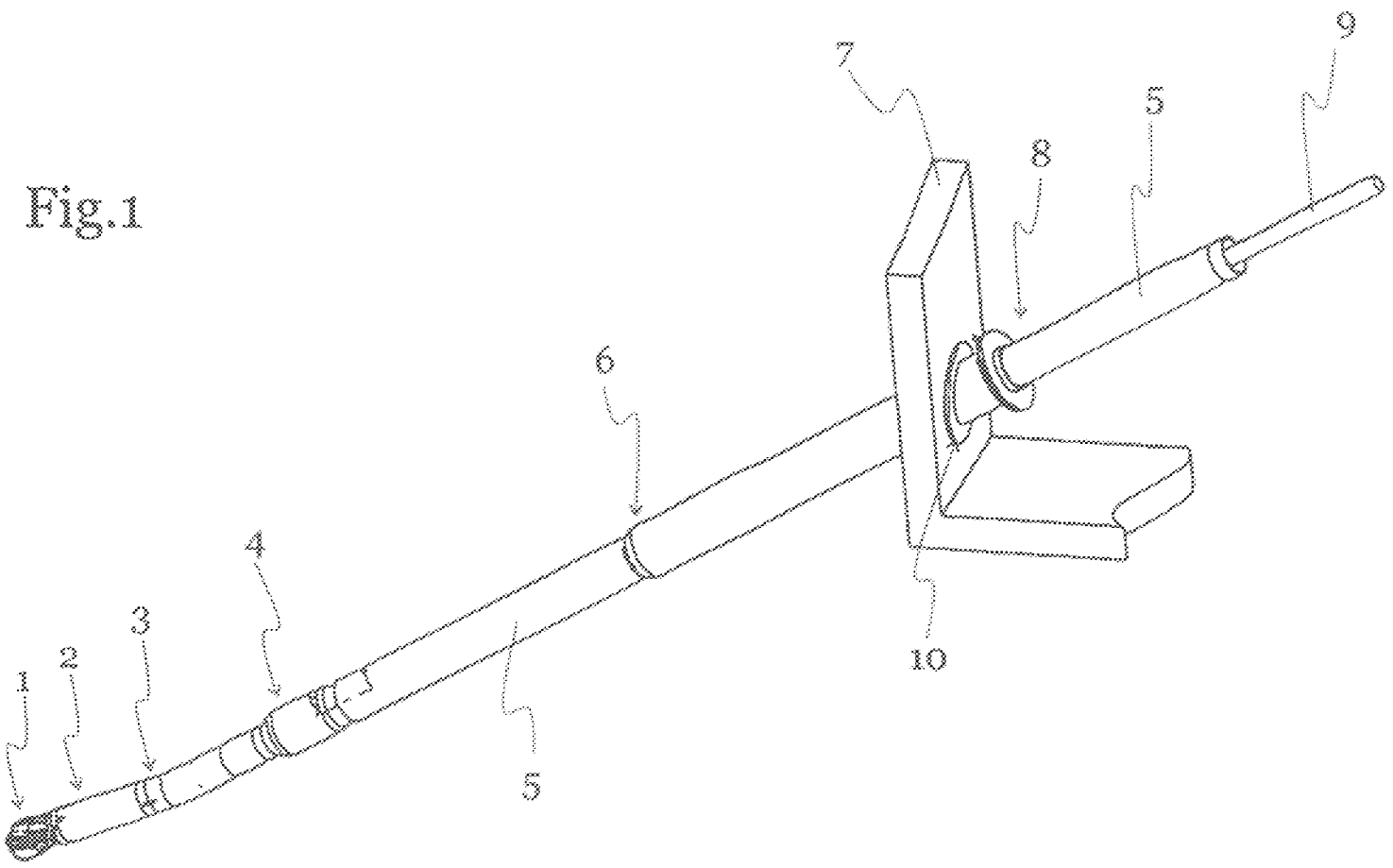
FIG. 1 shows a first embodiment of a steerable drilling system comprising a hydraulic motor according to the invention.

FIG. 1 shows a first embodiment of a steerable drilling system comprising a hydraulic motor according to the invention. The drilling system comprises a drill head 1 which is connected to a hydraulic motor 2. The hydraulic motor 2 is connected to a steering joint 3 which enables to steer the drill head 1 in the desired direction. The steering joint 3 is connected to a counter hold system 4 which is used to provide the counter torque to push the drill head 1 forward. The hydraulic motor 2 is placed in front of the steering joint 3, so that the use of a drive shaft through the steerable joint is avoided. The counter hold system 4 is connected to a tubular member 5 such as a protection pipe, which is followed by a protection sleeve 6. The whole drill system is introduced into the ground through a hole 10 in the wall 7 by means of an entrance arrangement 8, such as an entrance bracket, which is provided at the hole 10 of the wall 7 or any similar type of fixture. The tubular member 5 is visible, as the protection sleeve 6 is only provided under ground to ease the intrusion of the tubular member 5 by preventing the masses in the drilled hole to rest against the tubular member. In the tubular member 5, a central pipe 9 such as an umbilical or supply pipe is provided in order to introduce any necessary conduits such as hydraulic oil conduits to the drilling system, and also to transport crushed masses out of the drilling system.

The forward trust on the drill head 1 can be realized using separate systems both from out of the drill hole and from inside the bore. Several alternative systems can be used in combination or alone to provide the necessary counter torque and forward trust. The use of the tubular member 5 allows the drill head 1 to be pulled out of the bore, whereby the tubular member 5 is left in the drilled hole to prevent collapse.

In a further embodiment of the invention, a system to collect ground water before and during the drilling process can be provided. Such a system could be provided at the entrance arrangement 8.

Figure 2A:
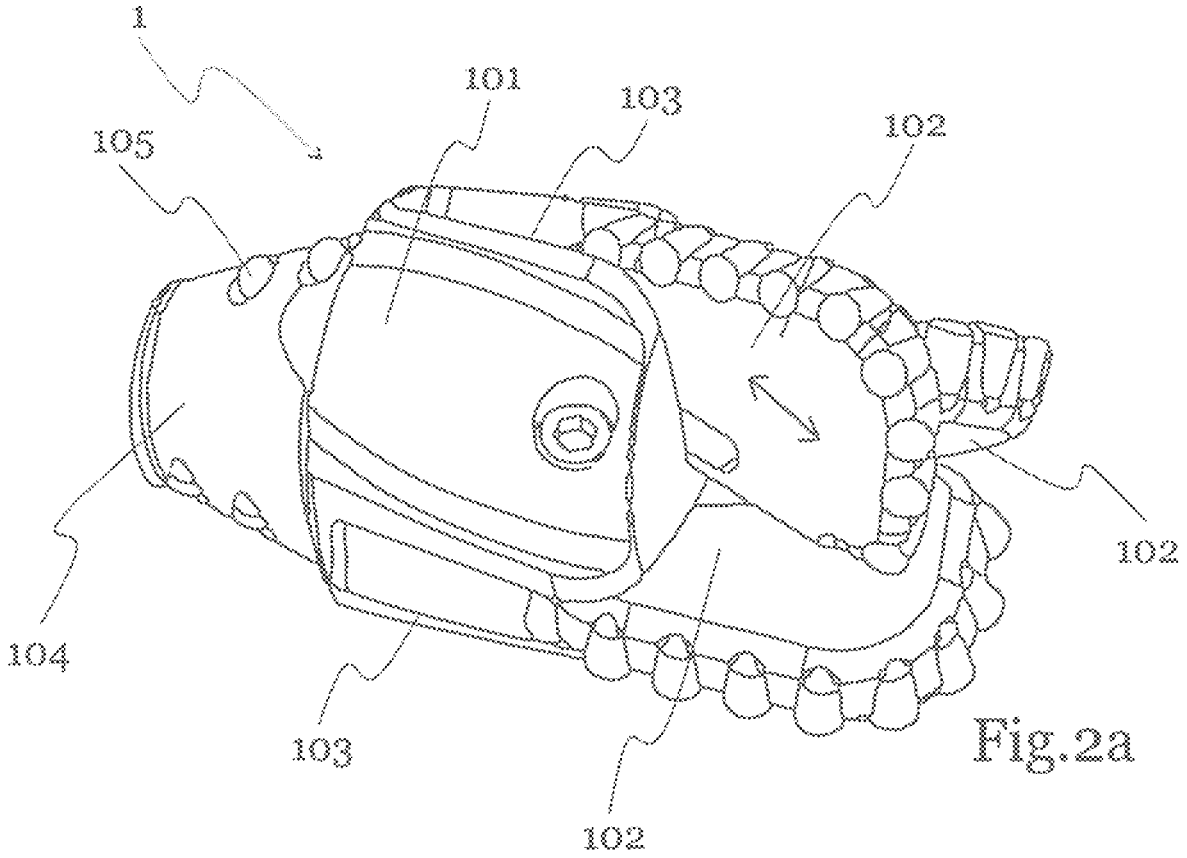
FIG. 2*a* shows an exemplary embodiment of the drill head.

FIG. 2*a* shows an exemplary embodiment of the drill head 1. The drill head 1 comprises a drill bit 101 with expendable reamers 102. In this exemplary embodiment, three expandable reamers 102 are provided. The reamers 102 are free to move in grooves 103 relative to both the axial and radial direction of the drill head. When the drill head 1 is pressed against the ground, the reamers 102 are pressed backwards against the grooves 103 and shift radially out at the same time, so that the radial extension of the drill bit 101 is increased. In alternative embodiments, the drill head 1 can be equipped with impact or hammering functionality together with drilling functionality in order to manage severe conditions with stones and varying formations in the ground. The impact functionality can be based both on a medium, such as oil or air, or on pure mechanical means. On the back of the drill bit 101, a crushing cone 104 is provided in order to crush and remove the drilled masses. The crushing cone 104 is equipped with hard bits 105, for example hard metal bits.

Figure 2B:
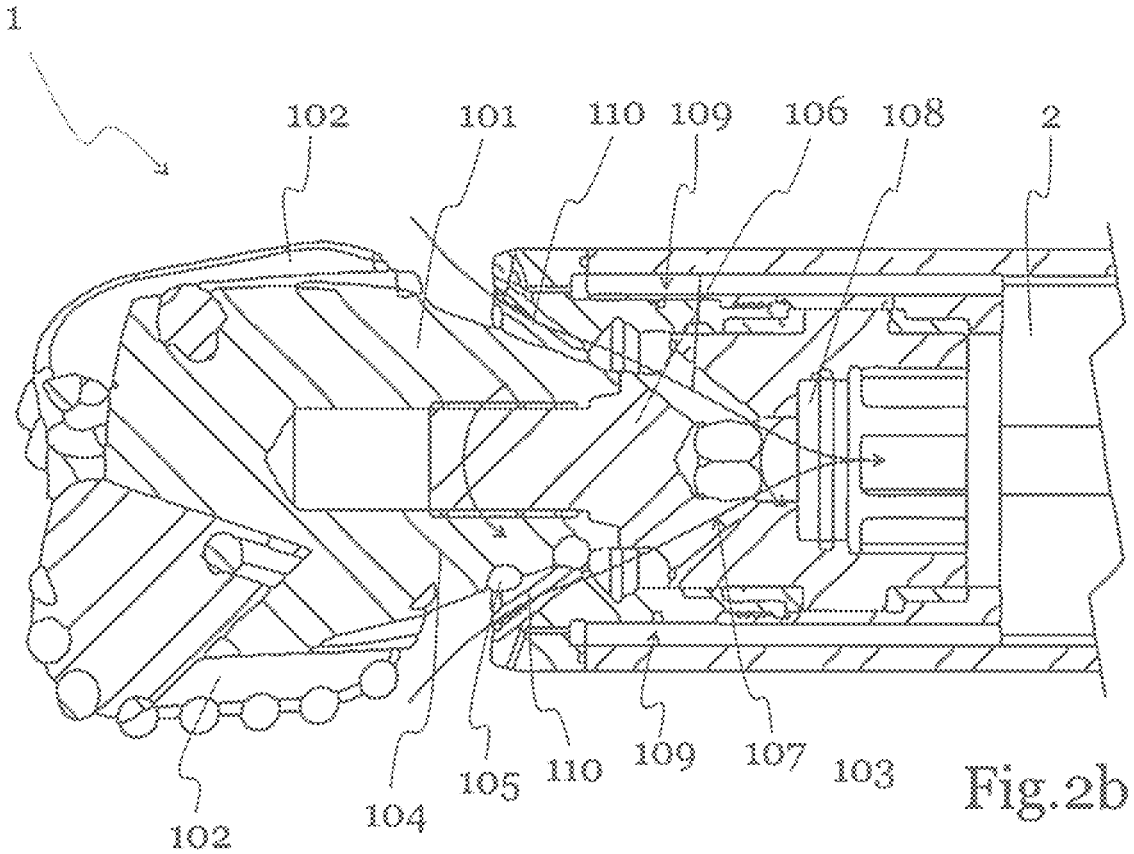
FIG. 2*b* shows a schematic cross section through the drill head and its interaction with the hydraulic motor.

FIG. 2*b* shows a schematic cross section through the drill head 1 and its interaction with the hydraulic motor 2. The hydraulic motor 2 drives the drill bit 101 over a shaft 106, which is connected to the rotor of the hydraulic motor 2. The rotor is hollow and forms a central pipe 108, so that a path to transport crushed masses out of the drill system is formed over the hollow space 107, as indicated by the arrows. The crushing of masses is achieved by rotation of the crushing cone 104 with respect to a stationary conical crushing ring 110. The conical crushing ring 110 comprises wedged slits and radial tracks where particles such as gravel up to a certain size are crushed to smaller particles and flushed into a central rotating pipe 108.

The crushing system is equipped with a flushing system 109 that aids feeding masses into the central pipe 108 as well as dissolving masses around the drill bit, such as clay, soil, or sand. A swivel at the end of the hydraulic motor shaft 106 is connectable to a central pipe 9 that provides suction and separation of the masses from inlet flush media, such as water. The hollow space 107 is equipped with nozzles that flush the masses into the rotating central pipe 108 in the core of the drill head drive axle. The central pipe 108 is in the core of the drive shaft for the drill head 1 and passes through the rotor of the hydraulic motor 2 on the way out of the drilling system. Thus, drilled and crushed masses can pass through the hollow core of the motor.

Figure 3A:
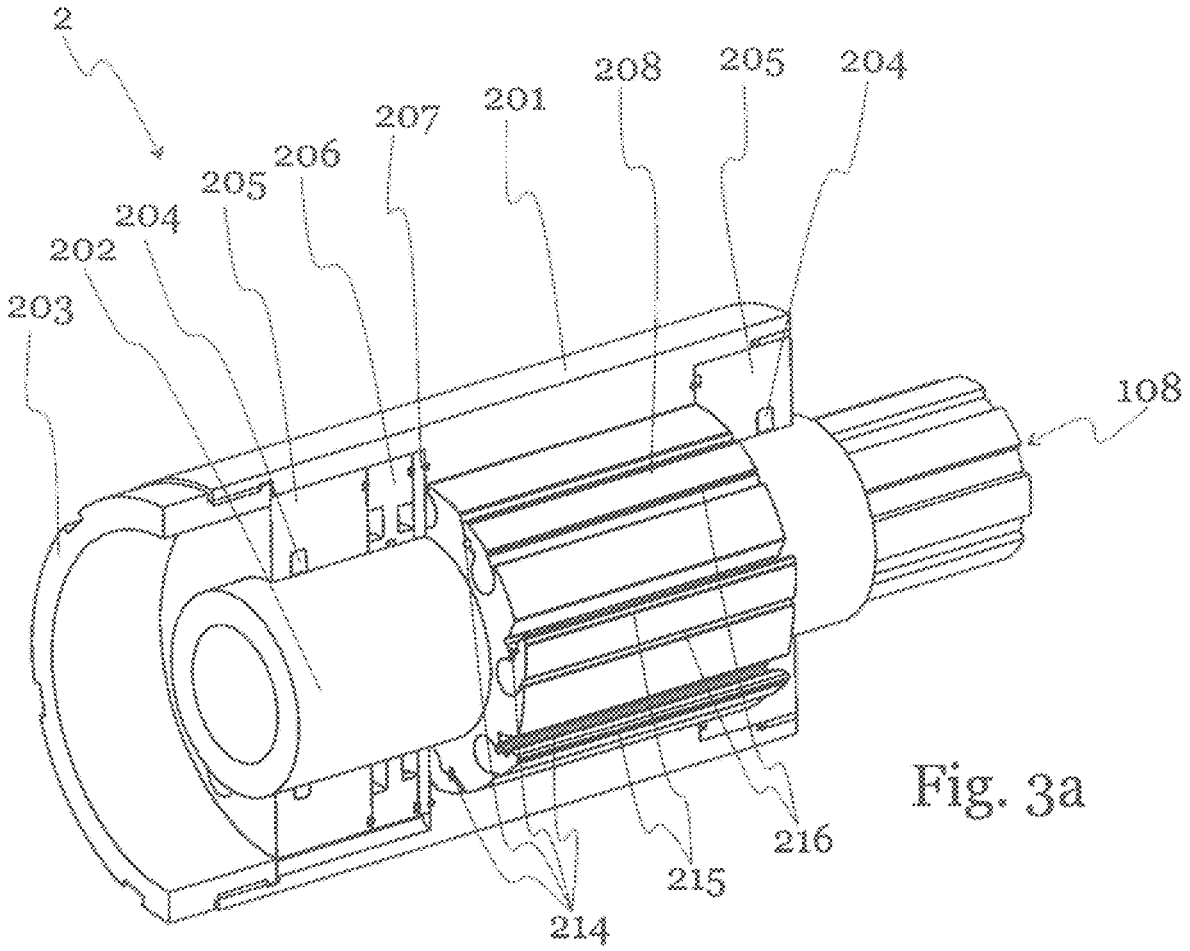
FIG. 3*a* shows a schematic representation of an embodiment of the hydraulic motor.

FIG. 3*a* shows a schematic representation of an embodiment of the hydraulic motor. The hydraulic motor 2 comprises a housing 201 with a central rotor 202. The rotor 202 is hollow to allow to pass a central pipe 108 through the motor 2. At the face of the housing 202 there is provided an end nut 203. Seals 204 and end lids 205 are provided to seal the rotor against the hydraulic medium. The hydraulic motor 2 is based on impellers in the form of axially rotating rocker vanes 208 which are provided on a central rotor 202. The rocker vanes 208 are able to swing out from the rotor to a limited radial distance such that when pressurized, they are preferably not in direct contact with the wall of the motor house 201. In a further embodiment, the rocker vanes are able to swing out from the rotor to such a radial distance that they get in contact with the wall of the motor house 201. Three vanes 208 are shown, where the upper vane is in a retracted state, and the lower two vanes are folded out. To enable the vanes 208 to fold out, elastic elements such as springs 214 are provided for each vane 208.

Figure 3H:
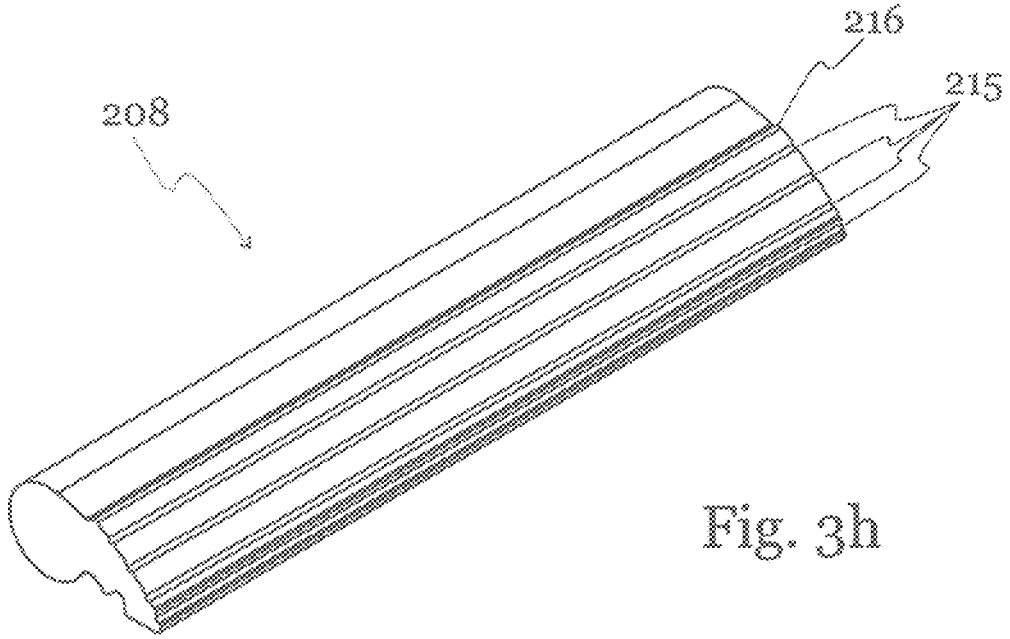
FIG. 3*h* shows a schematic representation of a vane.
Figure 3B:
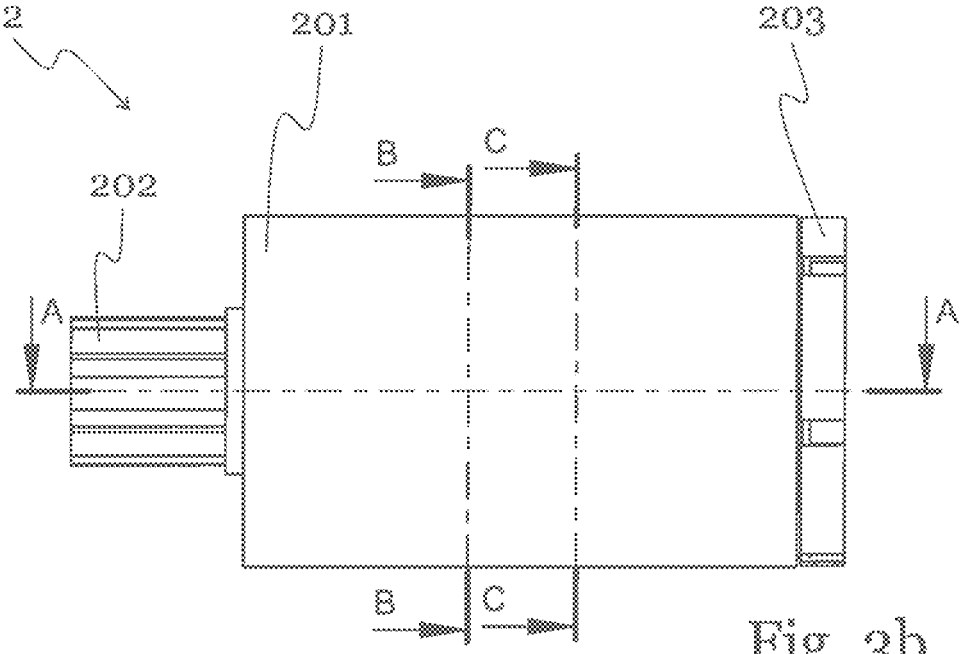
FIG. 3*b* shows a further schematic representation of the hydraulic motor with a central hollow rotor, a housing and an end nut.
Figure 3C:
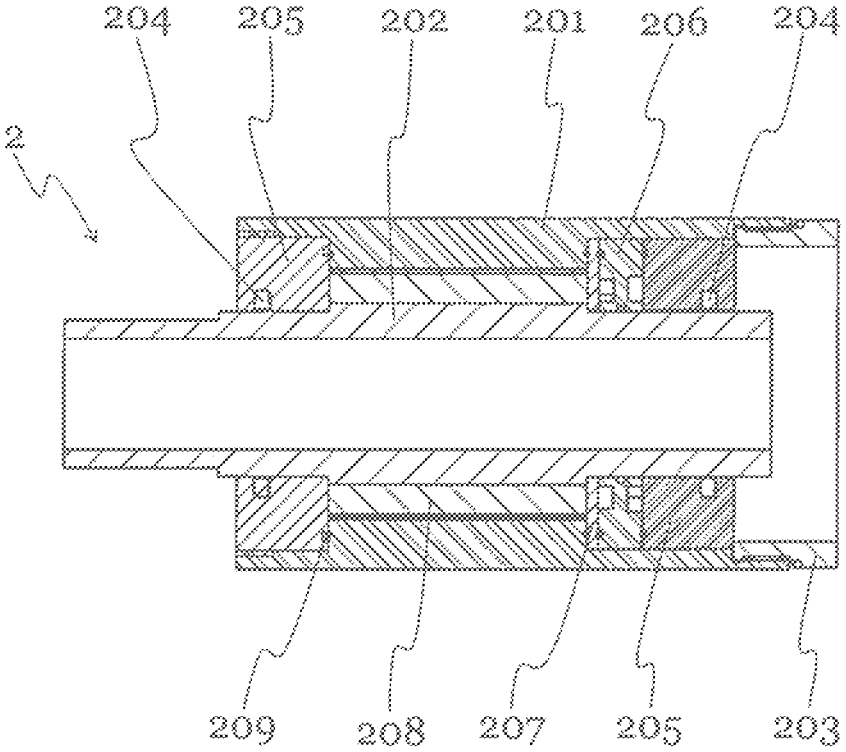
FIG. 3*c* shows the cut A-A indicated in FIG. 3*b;*

FIG. 3*b* shows a further schematic representation of the hydraulic motor 2 with a central hollow rotor 202, a housing 201 and an end nut 203. FIG. 3*c* shows the cut A-A indicated in FIG. 3*b*. The hydraulic motor 2 comprises a housing 201 with a central rotor 202. The rotor 202 is hollow in order to pass a central pipe 108 through the motor 2. At the face of the housing 202 there is provided an end nut 203 to couple the motor 2 to other components. Seals 204, end lids 205 and O-rings 209 are provided to seal the rotor against the hydraulic medium. Axially rotating rocker vanes 208 are provided on the rotor 202. A guide plate 206 and a port plate 207 is provided to correctly guide the hydraulic medium into and out of the motor.

Figure 3D:
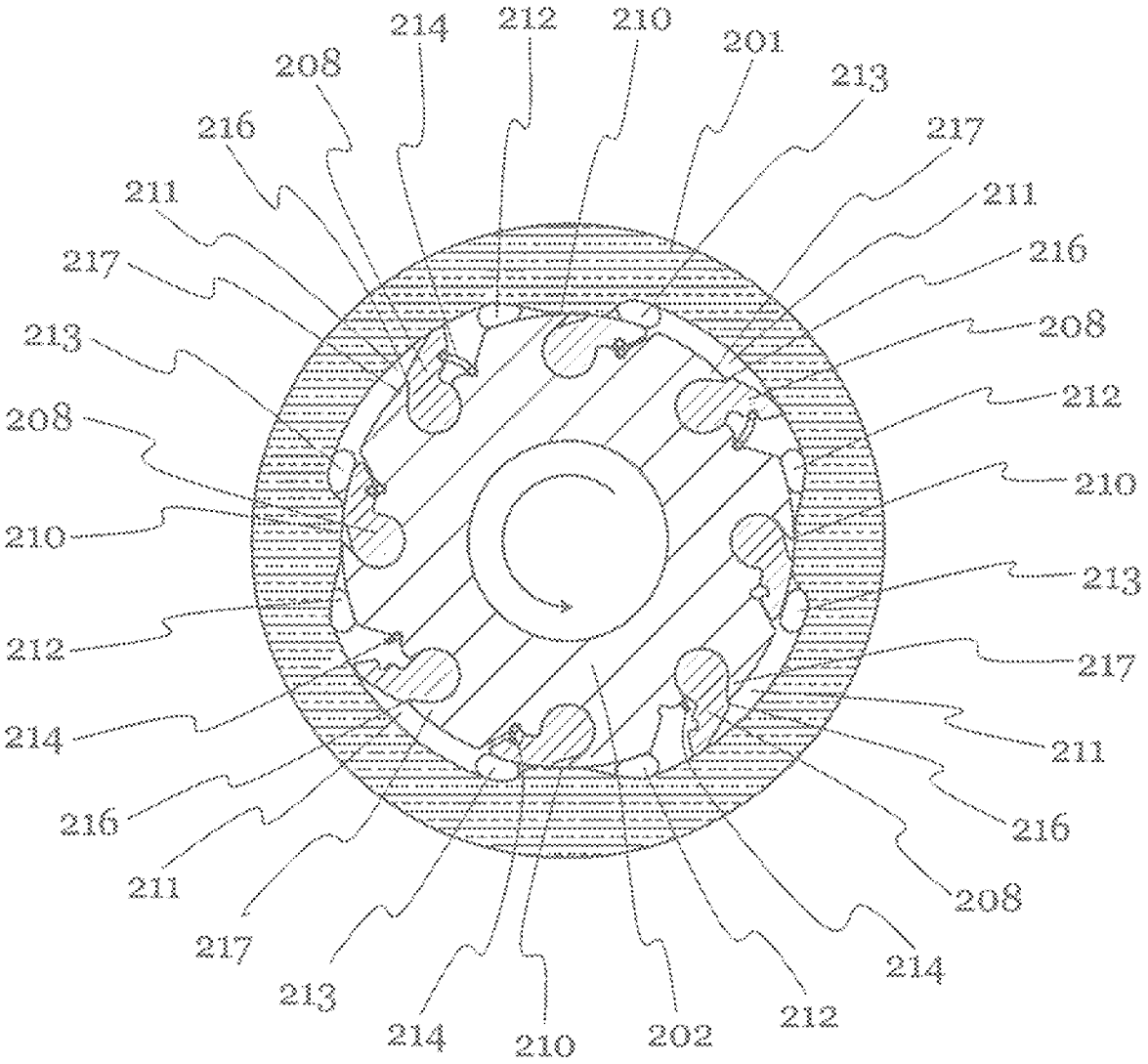
FIG. 3*d* shows the cut B-B indicated in FIG. 3*b;*

FIG. 3*d* shows the cut B-B indicated in FIG. 3*b*. The motor 2 has an outer housing 201 and a central hollow rotor 202. The rotor 202 carries eight vanes 208 which can swing around an axis that is parallel to the rotation axis of the rotor 202. On its inner surface, the housing 201 has four salient cams 210 which separate the annular space between the housing 201 and the rotor 202 into four separate hydraulic chambers 211. Within each chamber 211, the port plate 207 provides an inlet 212 and an outlet 213 for the hydraulic medium. Inlets 212 and outlets 213 are provided directly adjacent to each salient cam 210, so that in any position of the rotor 202, there is a vane 208 or a salient cam 210 provided between any inlet 212 and neighbouring outlets 213. In order to swing the vanes 208 out of their retracted state, elastic elements such as springs 214 are provided between the rotor 202 and each vane 208. Whenever a vane 208 passes a salient cam 210 and the inlet 212, the spring 214 moves the vane 208 axially out, so that the pressure of the medium pushes the vane 208 and drives the rotor 202.

The number of salient cams 210 is always two or more, and can be as many as necessary due to the wanted torque of the motor. The number of rocker vanes 208 on the rotor 202 is always higher than the number of salient cams 210 and is limited by practical design limitations such as the diameter of the motor chamber. With respect to rotation of the rotor 202 is the inlet 212 in the bottom at the end of the chamber 211, and the outlet 213 is in front of the chamber 211. The rocker vanes 208 are designed with a circular curved face at the rim and when folded into the rotor 202, they will be co-radial with the outer cylindrical part of the rotor cylinder 202. Thus, the rotor 202 will always form hydraulic chambers 211 between two salient cams.

When the rocker vanes 208 are between two salient cams 210, the vanes 208 will swing out towards the inside face of the housing 201 and thus will functioning as a piston with the inlet 212 on the back of the vane 208 and the outlet on front of the vane 208. The outward swinging of the vanes 208 is limited by the rotor geometry and the vanes 208 will in general not rest against the cylindrical face of the housing 201 when the pressure is active on the vane in the outer rotated position. When one vane 208 is entering the hydraulic chamber over the cam 210, the vane in front is leaving without active pressure from the inlet 212. When the vane 208 hits the salient cam 210 at the outlet, the pressure from the inlet 212 is already active on a new vane 208.

The internal seal system for the hydraulic motor is based on viscous sealing by slits due to the hydraulic flow of oil. In order to minimize the leakage, the vanes 208 can be equipped with longitudinal tracks 215 at their outermost ends that function as an extra flow resistance for the oil leakage. The inherent benefit with this design is the small size and that the motor does not need a valve system to control the inlet 212 and the outlet 213 hydraulic ports, as this is controlled by the rocker vanes 208 and the separation of each chambers by the salient cams 210. The motor design allows a central hollow shaft, which is a prerequisite for implementing functions such as a central pipe 108 through the central rotor core of the motor. The design allows a high volume efficiency since each hydraulic chamber 211 is always in operation on one rocker vane 208. Therefore, the start-up torque is not reduced during the course of the rotation. The vanes 208 have a mechanical stop 216, which touches the tip 217 of a recess in the outer surface of the rotor 202 in order to avoid an extensive axial displacement of the vane 208. Therefore, it is avoided that the vane 208 comes in direct contact with the housing 201.

Figure 3E:
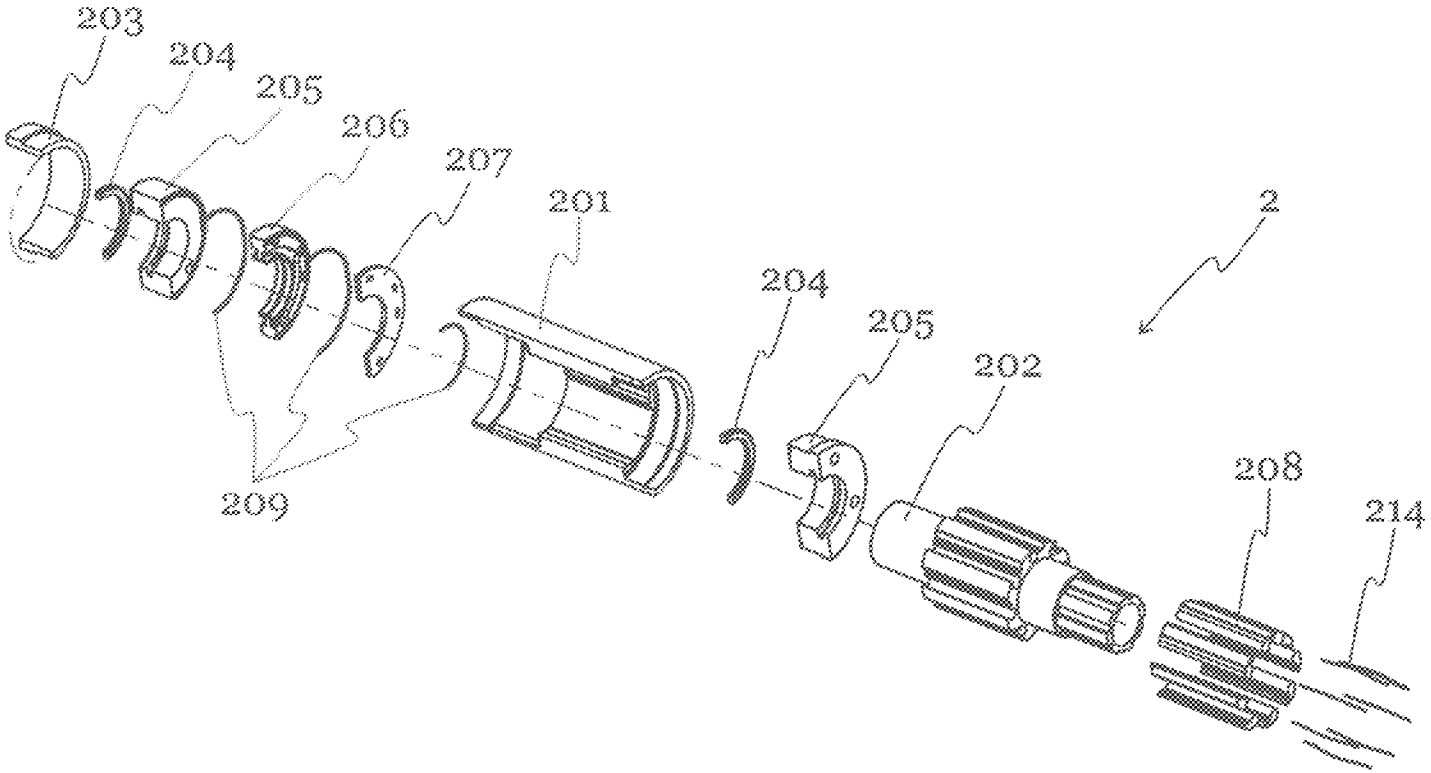
FIG. 3*e* shows a schematic explosion diagram of the main components of the motor.
Figure 3E:
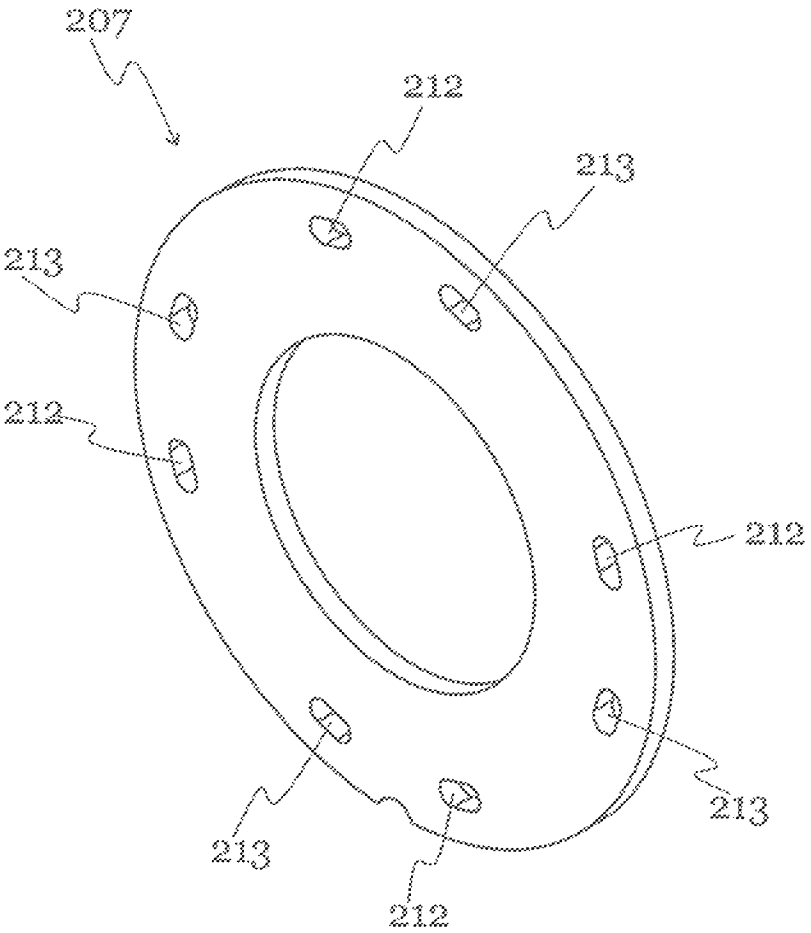
Figure 3F:
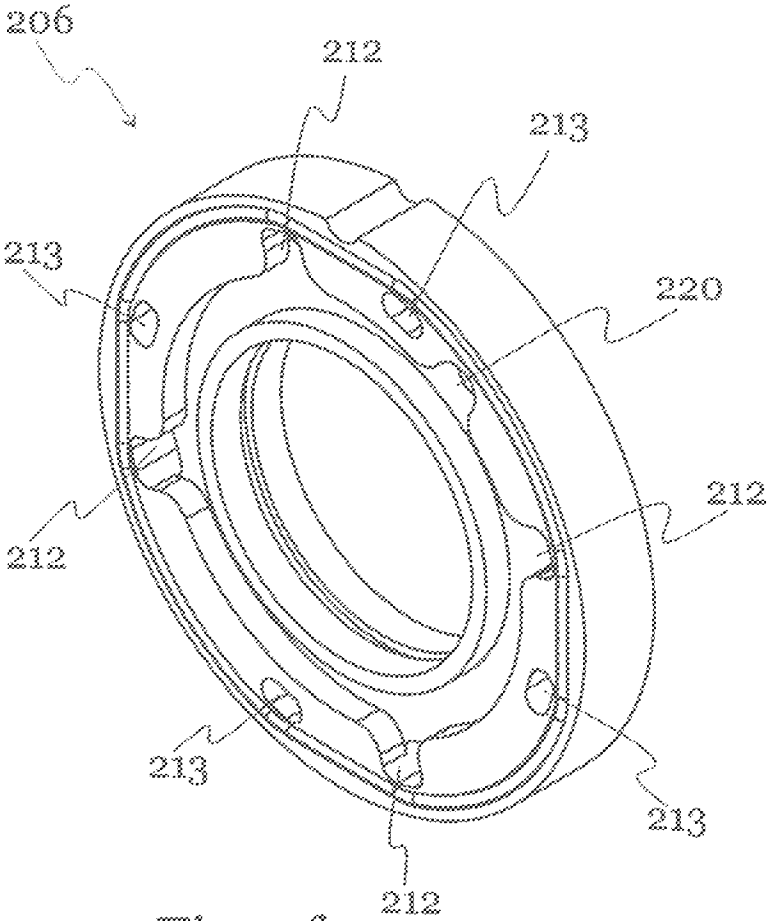
FIG. 3*f* shows a schematic representation of the guide plate.

FIG. 3*e* shows a schematic explosion diagram of the main components of the motor 1, which have been described above. FIG. 3*f* shows a schematic representation of the guide plate 206, which separates the four inlet ports 212 from the four outlet ports 213 and also shows the central inlet 220. FIG. 3*g* shows a schematic representation of the port plate 207, which leads the inlet ports 212 and outlet ports 213 into the chambers 211 of the motor 2. FIG. 3*h* shows a schematic representation of a vane 208, where the mechanical stop 216 is depicted, which is realized as an elongated protrusion at the outer surface of the vane 208. Further, the longitudinal tracks 215 at the outer surface of the vane 208 are seen, which provide an additional flow resistance against oil leakage.

Figure 3J:
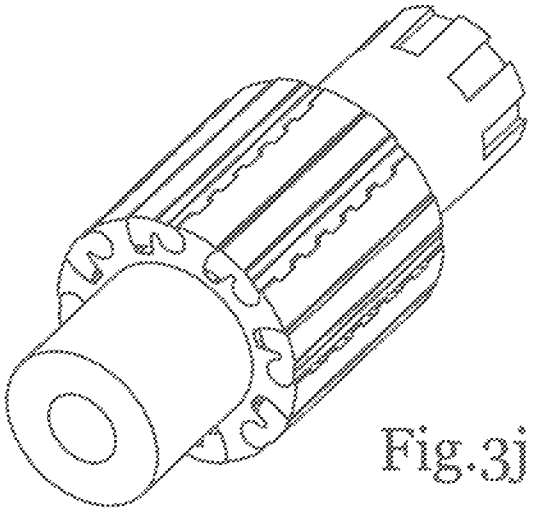
FIGS. 3*i*, 3*j* and 3*k* show a further embodiment of a hydraulic motor according to the invention.
Figure 3K:
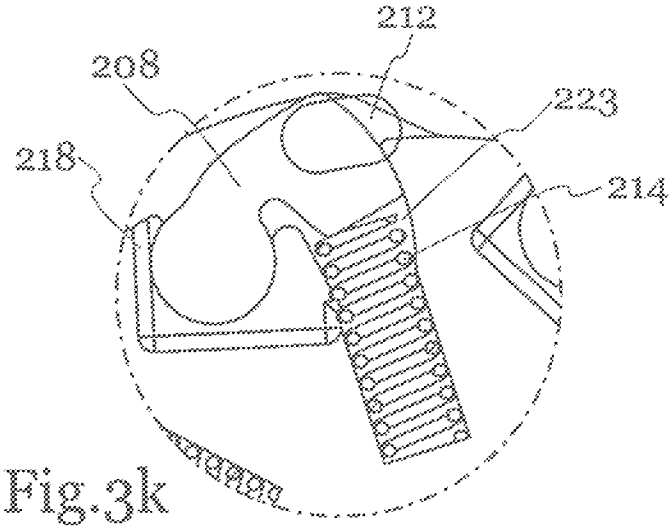
Figure 3I:
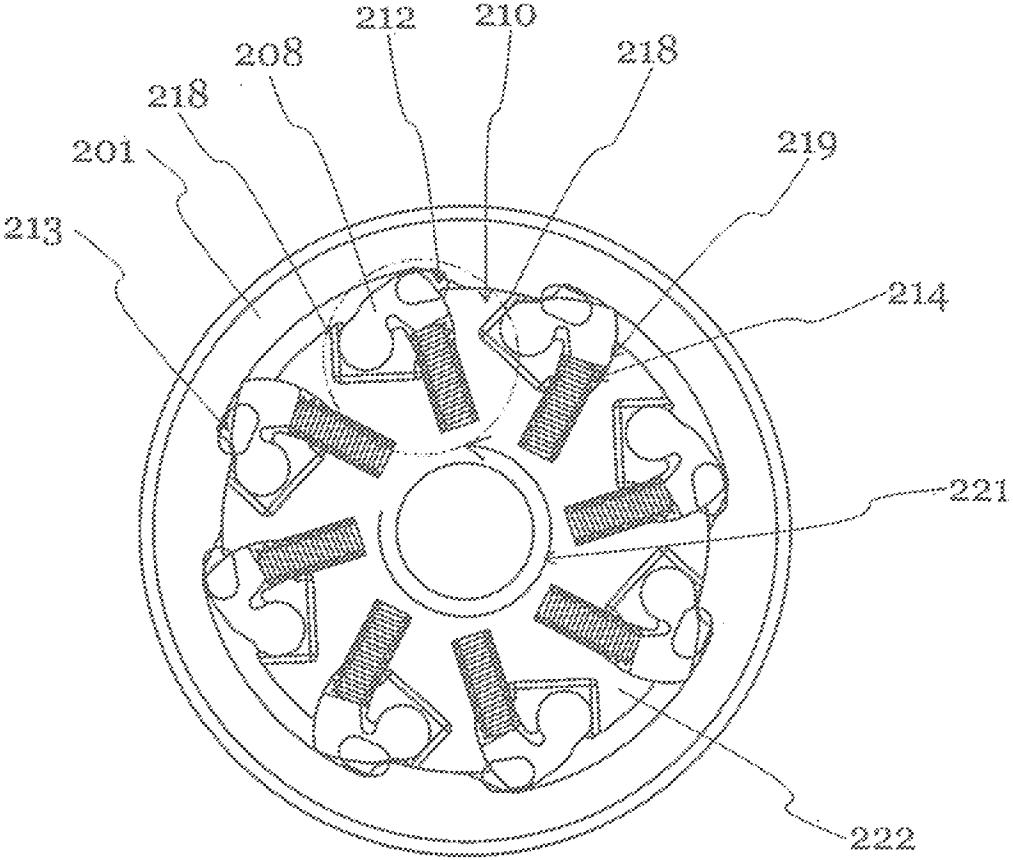

FIG. 3*i*-3*k* show a further embodiment of a hydraulic motor according to the invention. In this embodiment, the outward movement of the vanes 208 is not restricted by a mechanical stop, and thus a contact between the vanes 208 and the housing 201 is possible. However, in order to avoid the vanes being pressed against the housing 201 by the pressure difference between the inlet port 212 and the outlet port 213, the vanes 208 are pressure-compensated by a compensation vent 218. The compensation vent 218 is connected both to the inlet port 212 and to the outlet port 213 during the course of rotation of the rotor 202.

The compensation vent 218 thus eliminates the force pressing the vanes 208 outwards against the housing 201 that is caused by the pressure difference between the inlet port 212 and the outlet port 213. It leads from an opening at the front side of the vane 208 back to a pressure balancing chamber 223 in which a compression spring 220 is provided. The pressure balancing chamber is limited by the radius 219 on the vanes 208 that fits closely with the rotor 222. During the normal course of rotation, as indicated by the arrow 221, when the front of the vane 208 has passed the salient cam 210, the vent 218 is pressurized by the inlet port 212 in such a way that the pressure is transferred to the pressure balancing chamber 223, so that the vane 208 is pressure balanced while brought against the housing 201. As soon as the vane 208 has passed the inlet port 213, the pressure compensation vent 218 is exposed to the outlet port 213, so that the pressure balancing chamber 223 is depressurized, and the vane 208 is not further pressed against the housing 201.

When the vane 208 passes the outlet port 213, the vane 208 contacts the cam 210 and is forced inwards again. However, the oil inside the pressure balancing chamber 223 is forced backwards through the compensation vent 218 due to the inward movement of the vane 208. This excess oil will build a film between the outer surface of the vanes 208 and the salient cams 210, so that mechanical contact is substantially prevented. Any oil leakage from the inlet port 212 of the next chamber to the outlet port 213 of the previous chamber will be conducted into the compensation vent 218 and thus balances the vanes 208 when passing the cams 210.

Figure 4A:
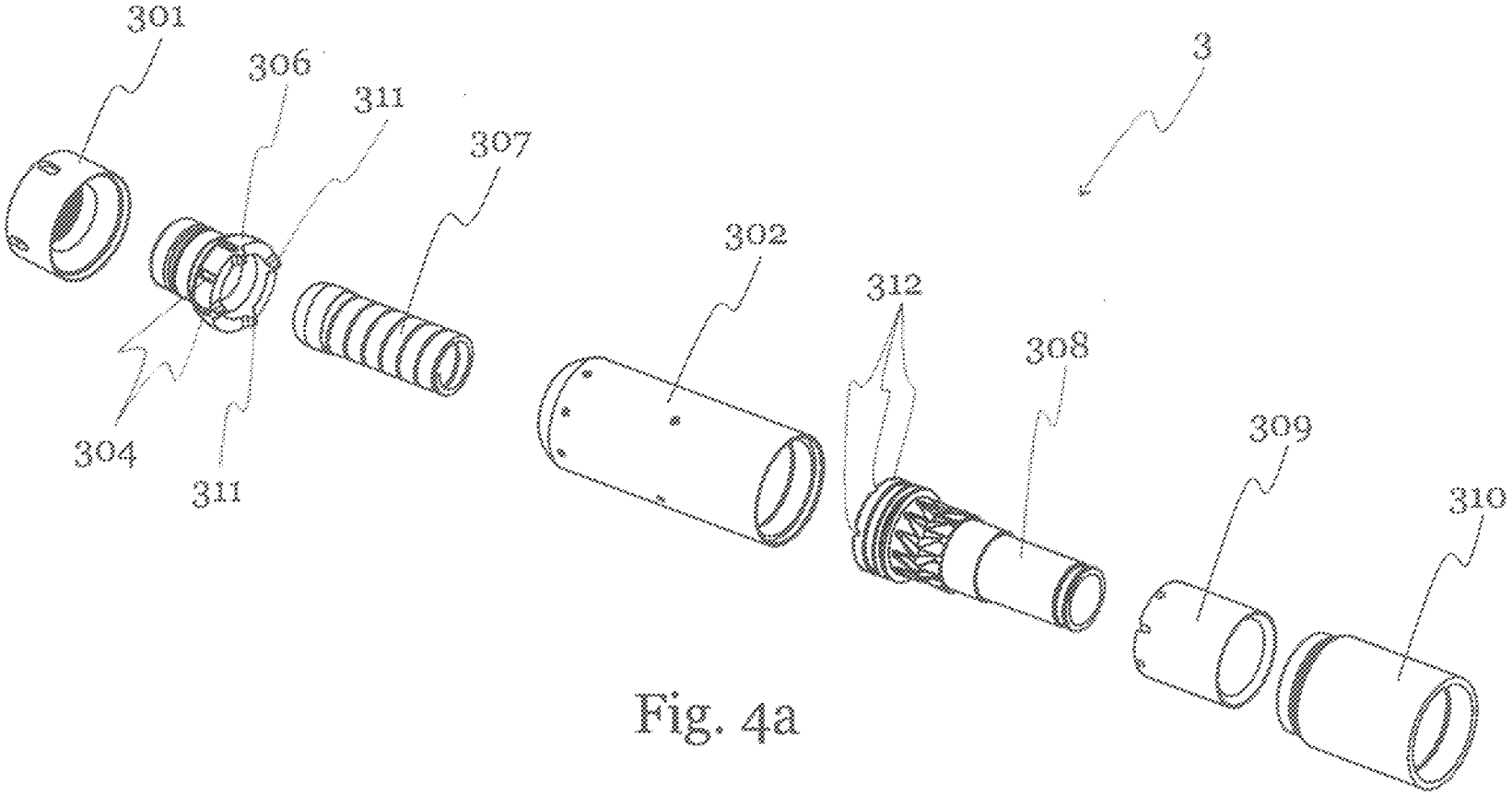
FIG. 4*a* shows a schematic representation of an embodiment of a steering joint.

FIG. 4*a* shows a schematic representation of an embodiment of a steering joint 3, which allows direction control of a drilling system such as the one shown in FIG. 1 during drilling. The steering joint 3 is mounted after the hydraulic motor 2 and is hollow to allow to pass a central pipe which can be used, for example, for supply functions or waste removal. The overall functionality of the steering joint is to provide a stepwise controlled steering orientation with predetermined bending angles for each step. The steering joint 3 comprises an upper tubular 301 and a lower tubular 302, which are connected by a universal joint 303 comprising several parts as explained below, which allows the upper tubular 301 to bend with respect to the lower tubular 302.

The upper tubular 301 and the lower tubular 302 are coupled to each other in such a way, that individual rotation relative to each other is prevented. This is achieved by means of pins 305 on a pin keeper 309 at the inside of the lower tubular 302, which engage into axially oriented groove tracks 304 on the outside of the universal joint 303, so that the upper tubular 301 and the lower tubular 302 can be tilted, but are rotationally locked to each other. The lower tubular 302 is encased by an end lid housing 310.

Figure 4B:
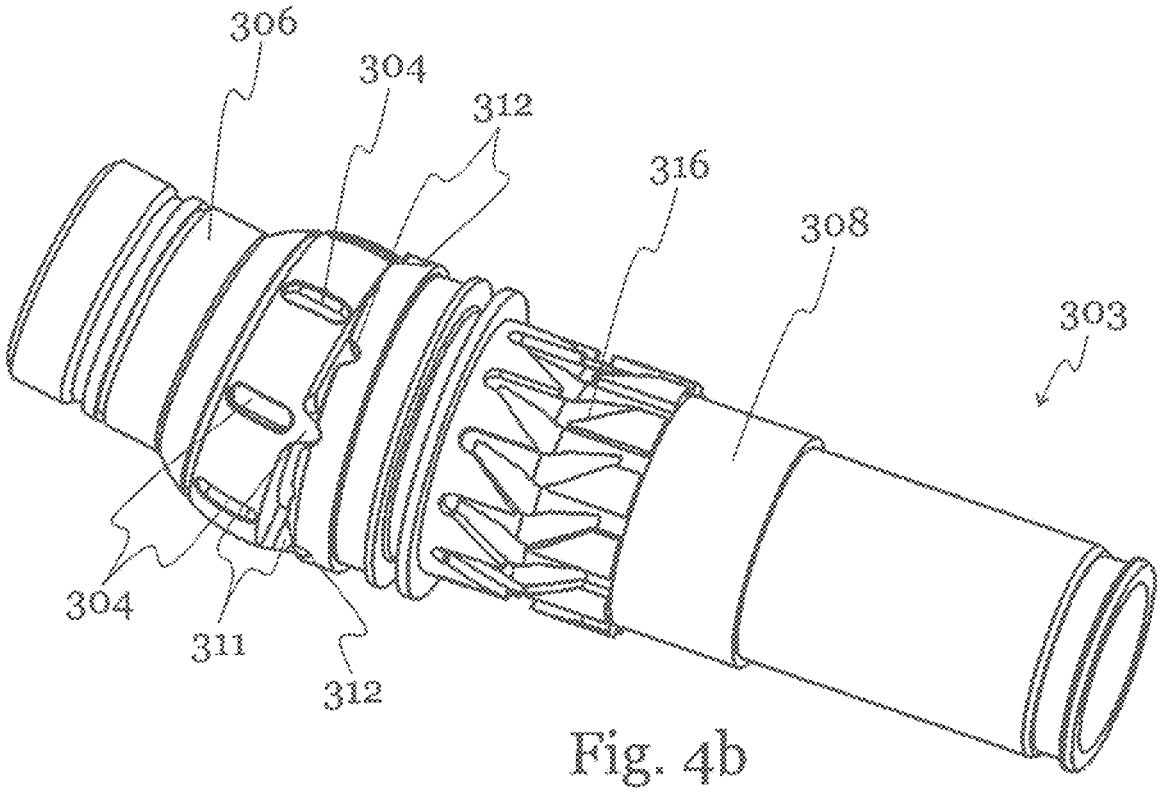
FIG. 4*b* shows a schematic representation of the universal joint.

FIG. 4*b* shows a schematic representation of the universal joint 303. It comprises a bell-shaped bearing socket 306 with axial groove tracks 304 on its outer surface, a cylindrical step piston 308, and a mechanical spring 307 inside the step piston 308. At its outer surface, the step piston 308 comprises circumferential slotted wedges or wedged tracks 316. The steering principle is based on the ends of the bearing socket 306 and the step piston 308 being axially connected by means of multiple radial cams 311 on the face end of the bearing socket 306 engaging into differently sized radial grooves 312 on the face end of the step piston 308. The radial grooves 312 are of different depth and are disposed in inclined planes on the face end of the step piston 308. In contrast to the radial grooves 312, the radial cams 311 are of equal size.

For each desired steering angle, the step piston 308 is equipped with three or more grooves 312, which are distributed at the face end of the step piston 308 in order to form a stable end-to-end connection with the radial cams 311 at the face end of the bearing socket 306. The grooves can be distributed equally at the face end of the step piston 308. By rotating the step piston 308 and aligning the grooves 312 at the desired tilting angle with the cams 311, the grooves 312 on the step piston 308 match with the radial cams 311 on the bearing socket 306 and force the joint assembly to be directed in the wanted orientation. In a typical design, the step piston 308 is designed with three inclination angles for four grooves 312 distributed around 360 degrees, i.e. 90 degrees for each set of different grooves 312. This results in a total of twelve steps with a rotational stepwise orientation of 30 degrees between each step where 4 of the steps are in the straight forward direction, thus nine different orientations are achievable. The arrangement of grooves 312 in specific angles can, for example, be zero, four and eight degrees. At zero degree is the steering assembly straight without bending, and at 4 and 8 degrees is the upper tubular 301 as well as the bearing socket 306 angled in 4 or 8 degrees in one of the four directions of the radial cams 311.

Figure 4C:
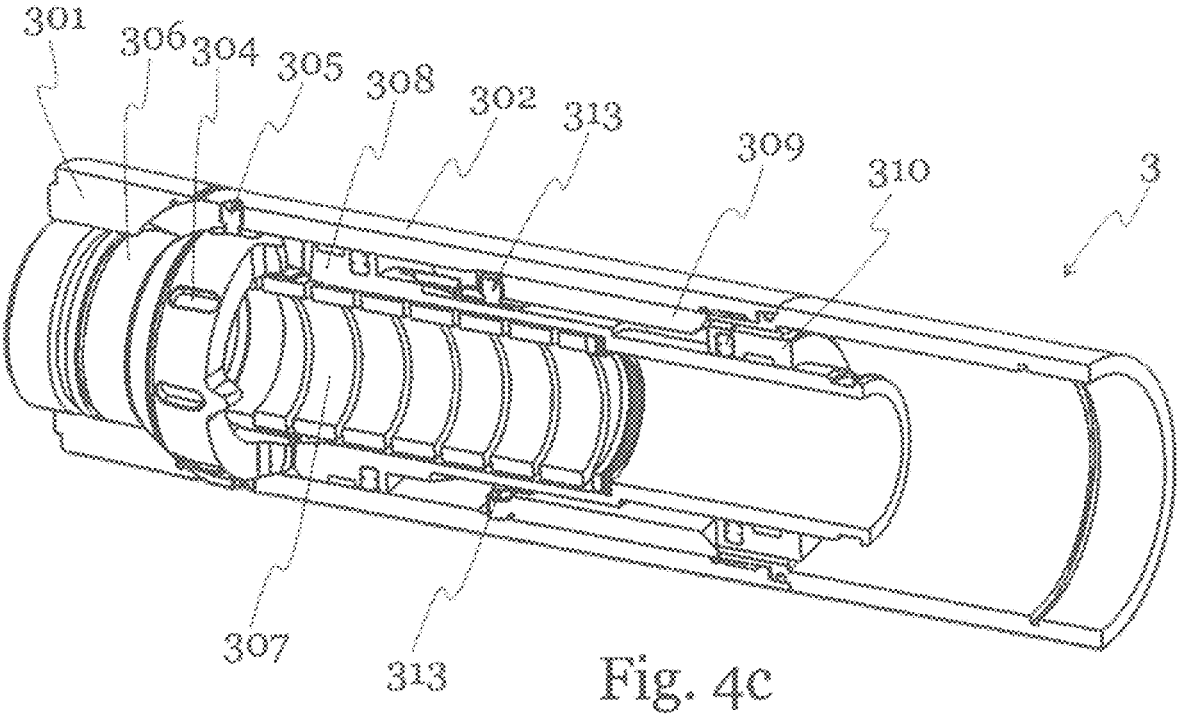
FIG. 4*c* shows a schematic and half-cut view of the steering joint.

FIG. 4*c* shows a schematic and half-cut view of the steering joint 3, where part of the step piston 308 is removed for clarity. It shows the pins 305 which are provided at the inner surface of the lower tubular 302 and engage into the radial groove tracks 304 of the bearing socket 306 for a positive radial connection between the lower tubular 301 and the upper tubular 302. In order to set the steering angle, it is necessary to rotate the step piston 308 in a stepwise fashion. In one embodiment, the stepwise rotation is made possible by wedged tracks 316 at the outside of the step piston 308. The wedged tracks 316 are engaged by counter holding pins 313 fixed to a cylindrical pin keeper 309, which is connected to the lower tubular body 302. The stepwise orientation is achieved by an axial movement of the step piston 308 in a way that forces the piston 308 to rotate half of the rotational step in one directional movement one way. A reciprocal movement back and forth of the piston 308 will rotate the piston one full step. This mechanism is similar to the mechanism responsible for protruding and retracting the tip in some ballpoint pens. The force for the axial forward movement of the step piston 308 is created by hydraulic pressure, and the return force is provided by a mechanical spring 307, which is arranged inside the step piston 308. The grooves 312 at the face end of the step piston 308 will engage with the cams 311 at the bearing socket 306 and thus force the bearing socket 306 and the upper tubular 301 in the desired direction in fixed inclined angles for each of the orientation of the radial cams 311.

Figure 4D:
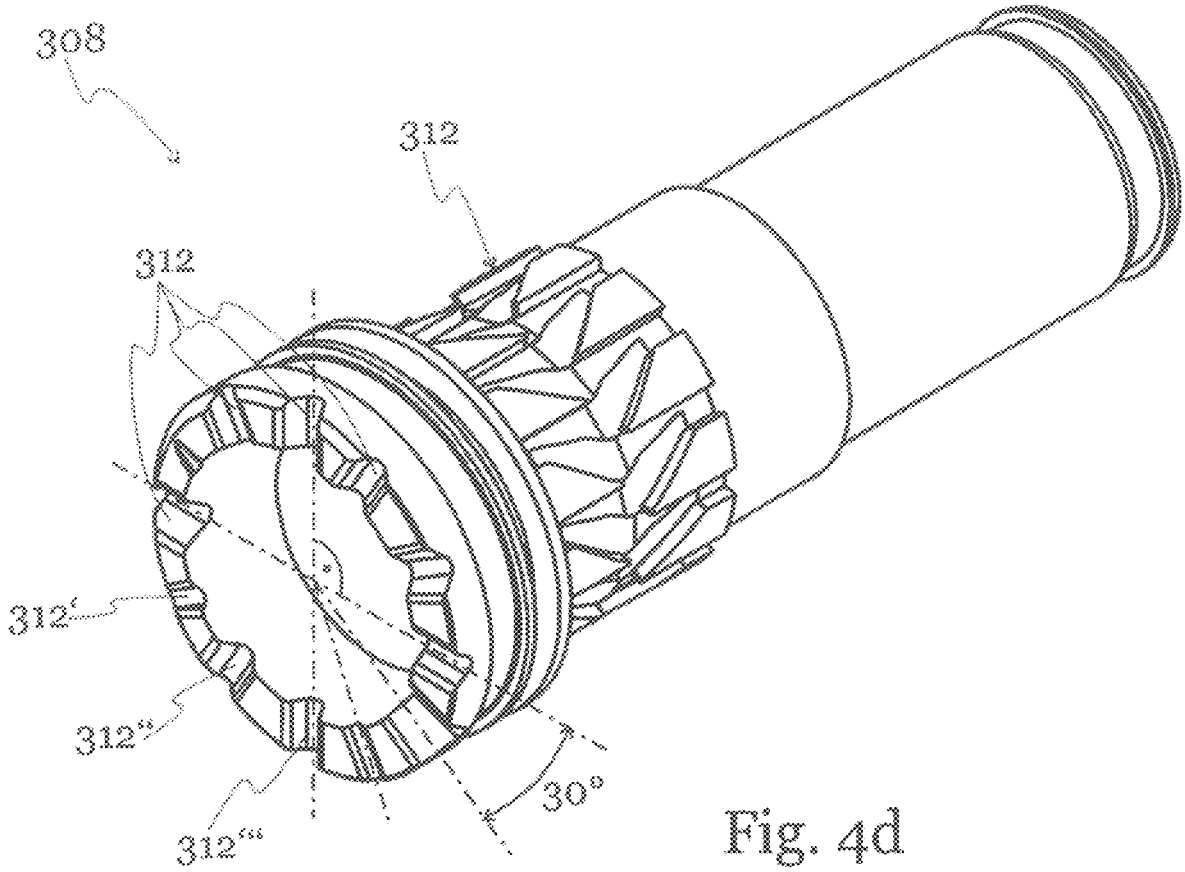
FIG. 4*d* shows a schematic view of the step piston.
Figure 4E:
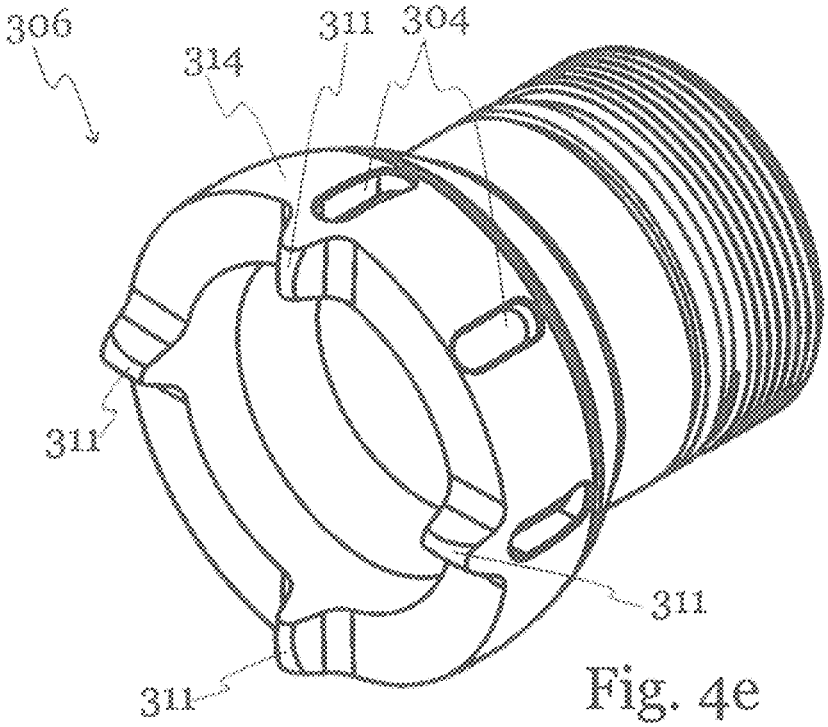
FIG. 4*e* shows a schematic view of the bell-shaped bearing socket.

FIG. 4*d* shows a schematic view of the step piston 308. At the face end of the step piston 308, differently sized radial grooves, namely shallow grooves 312', regular grooves 312", and deep grooves 312''' are provided. In this specific embodiment, each groove 312 is displaced at an angle of 30° from the neighboring groove 312. FIG. 4*e* shows a schematic view of the bell-shaped bearing socket 306. It comprises an annular flange 314 with circumferential axial grooves 304 and four axial cams 311, placed at an angle of 90 degrees. Each axial cam 311 has the same axial extension.

In an additional embodiment of the steering joint, the rotation of the step piston is performed by an electric motor. This motor can be a stepper motor or a hydraulical or electrical motor-gear system that provides the wanted rotation in fixed steps. The benefit of a pure hydraulic system is the robustness and versatility of the construction. This aspect is important in relation to necessary control or actuation electronics in the drill head.

As a further advantage, when the hydraulic pressure is removed, the steering assembly will be free to bend in any direction without any counter force. This is very important if the drill head assembly has to be pulled back through the drilled hole.

The use of a one-way operated hydraulic piston with a spring return that both provides the rotation and orientation in the same movement, and provides the desired tilting angle and three-dimensional orientation can be achieved by a single hydraulic control line. The actual steering orientation for the joint is controlled by the rotational position of the piston 308. The rotational position can be measured by an electrical circuit with feedback sensor that measures the absolute position of the piston rotation. The orientation of the steering system in relation to the global direction can be determined by a position measurement system that detects the orientation of the upper part tubular housing of the steering joint and thus relates the orientation of the lower part of the steering joint relative to this measured orientation in a stepwise way.

Figure 4F:
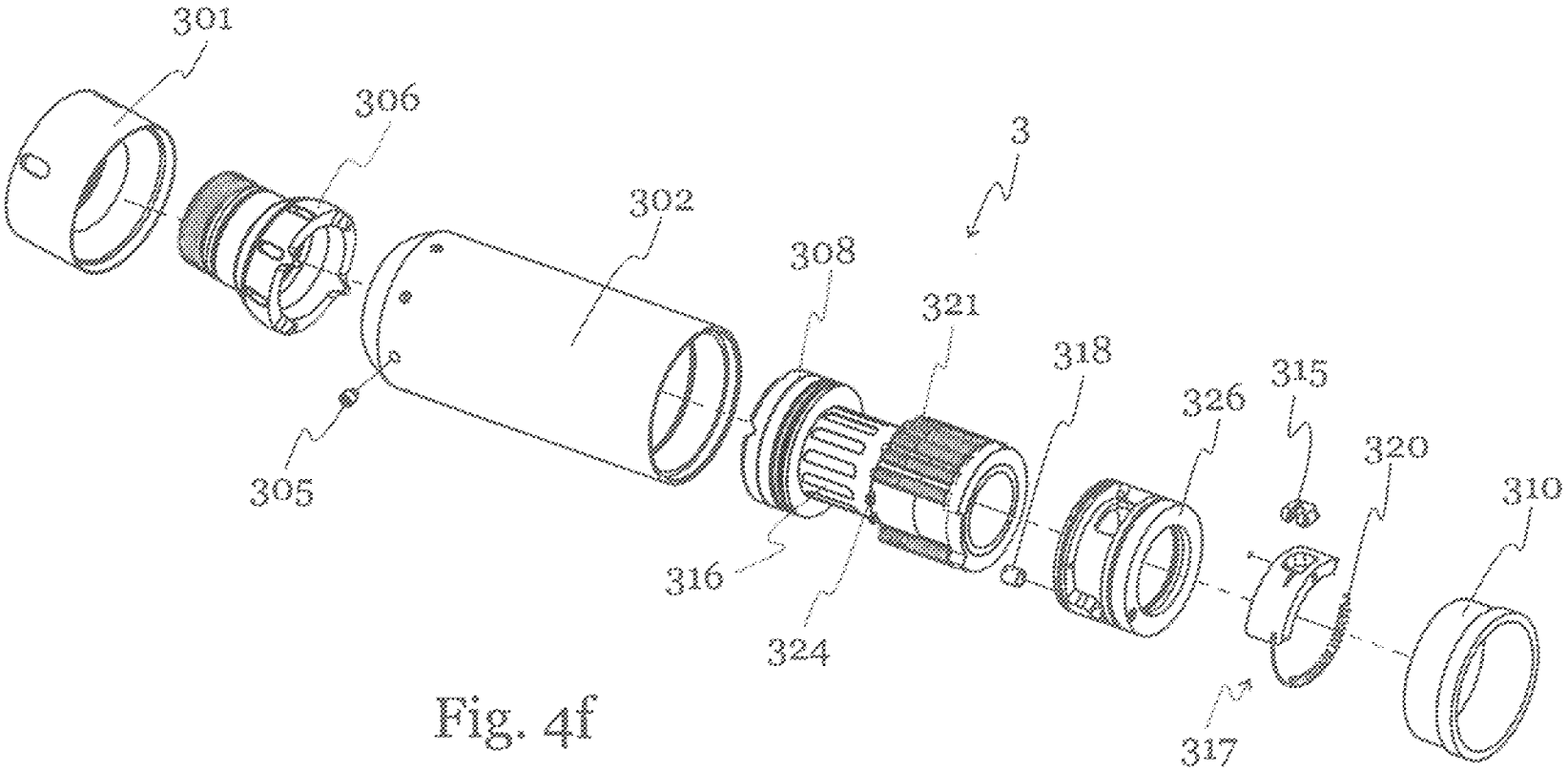
FIG. 4*f* shows a further embodiment of the steering joint in a schematic explosion view.
Figure 4G:
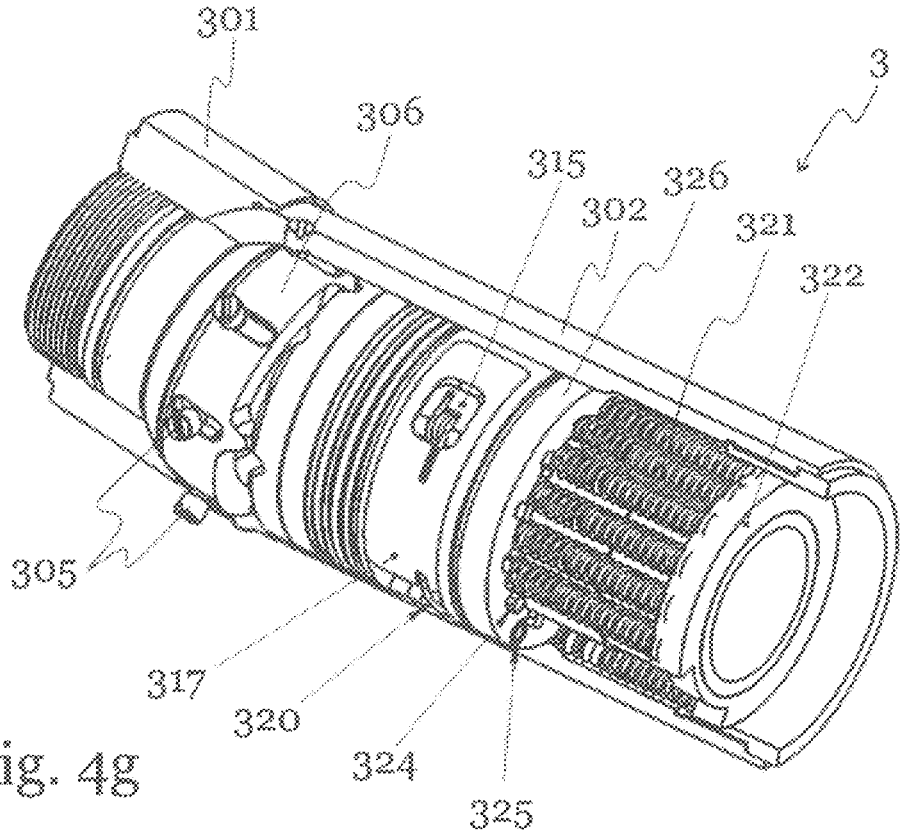
FIGS. 4*g* and 4*h* show this embodiment in a schematic assembled configuration.
Figure 4H:
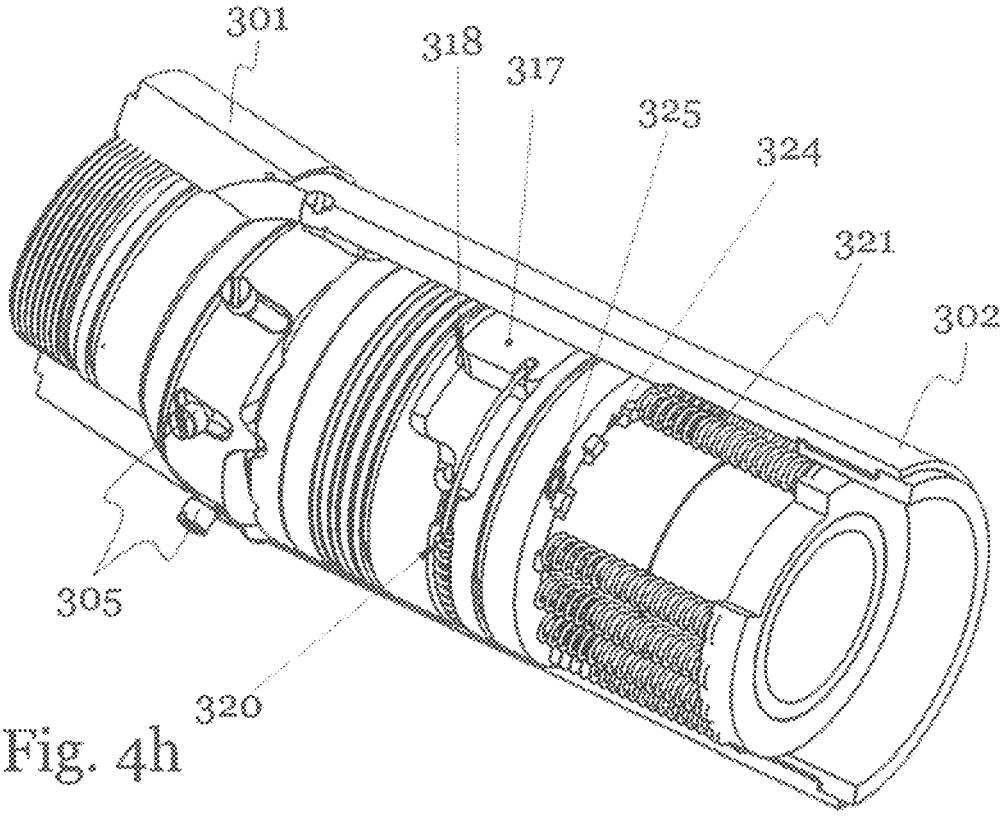
Figure 4K:
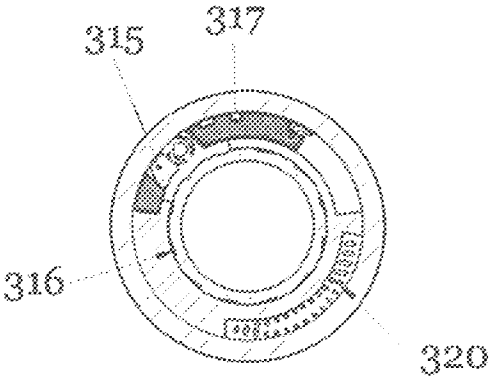
FIGS. 4*i*, 4*j* and 4*k* show further views of this embodiment.
Figure 4I:
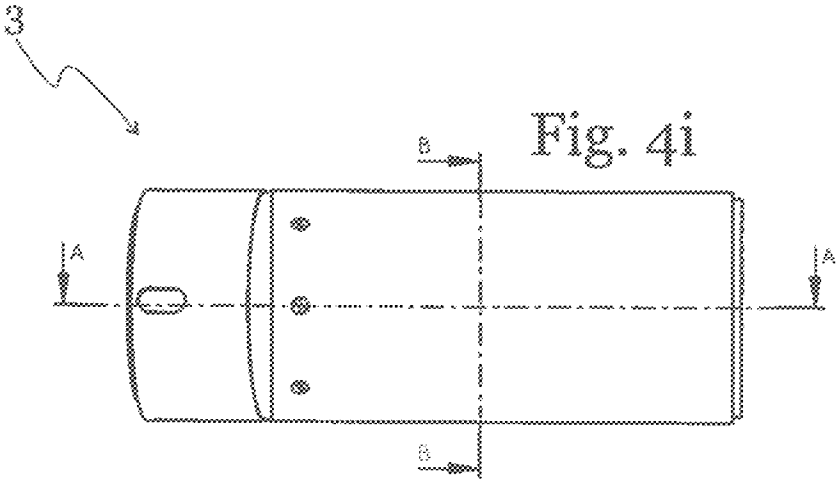
Figure 4J:
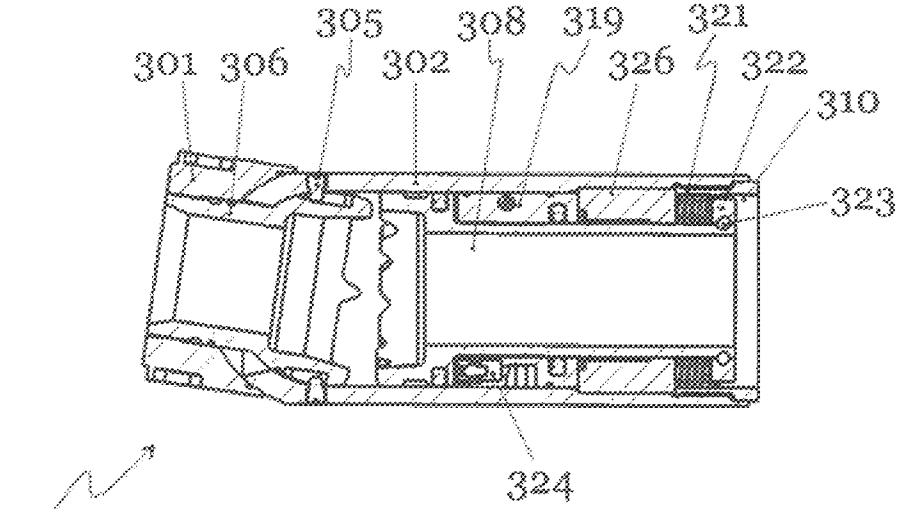

FIG. 4*f* show a further embodiment of the steering joint 3 in a schematic explosion view. FIG. 4*g* and FIG. 4*h* show this embodiment in a schematic assembled configuration, where parts of the tubulars have been cut away for clarity. FIG. 4*i*-4*k* show further views of this embodiment. In this embodiment, the steering joint 3 comprises an upper tubular 301 and a lower tubular 302 which are connected by a universal joint 303, which allows the upper tubular to bend with respect to the lower tubular. The upper tubular 301 and the lower tubular 302 are coupled to each other in such a way, that individual rotation relative to each other is prevented. This is achieved by means of pins 305 on a pin keeper 309 at the inside of the lower tubular 302, which engage into axially oriented groove tracks 304 on the outside of the universal joint 303, so that the upper tubular 301 and the lower tubular 302 can be tilted, but are rotationally locked to each other. The lower tubular 302 is encased by an end lid housing 310. In order to set the steering angle, it is necessary to rotate the step piston 308 in a stepwise fashion. In this embodiment, the stepwise rotation of the step piston 308 is achieved by a circumferential hydraulic piston 317 operating rotationally in an annular rotator housing 326, that rotates the step piston 308 the required step. A carrier 315 that engages with wedged tracks 316 on the shaft of the step piston 308 provides the mechanical connection between the step piston 308 and the hydraulic piston 317 to perform the rotation of the step piston 308.

This movement is operating similar to a ratchet and an oscillating movement of the hydraulic piston 317 will provide the rotational movement of the step piston 308. The oil flow design for the circumferential hydraulic piston 317 and the piston 308 is made in such a way that the inflow of the hydraulic medium into the pistons through the inlet hole 318 will first actuate the circumferential piston 317 until it is at the end position, where any additional movement is prevented by the rotator housing 326. In FIG. 4*g*, the circumferential piston 317 is depicted in its initial state, and in FIG. 4*h*, the circumferential piston 317 is rotated to its end position. When the circumferential piston 317 is at its end position, the inlet hole 318 from the side of the cylinder bushing 319 opens due to the movement of the circumferential piston 317. This stops the rotating, ratchet-type movement and allows the oil to flow freely into the main step piston 308 chamber.

If the selected position of the main step piston has been obtained, a continuous adding of a hydraulic medium forces the main step piston 308 to move axially towards the bearing socket 306, thus providing the steering angle adjustment. If the selected position of the main step piston has not been reached, a bleed-off of the hydraulic medium will return the circumferential hydraulic piston 317 by a return mechanism. The displacement volume in the rotator housing 326, where the circumferential hydraulic piston 317 operates, can be hydraulically compensated to the step piston chamber. This compensation provides an axial movement of the step piston 308 that is kept below the needed axial movement for engaging with the bearing socket 306.

The circumferential hydraulic piston 317 is equipped with a return spring 320 that provides the return rotation and allows for the next step to be engaged after pressure has been provided to the hydraulic medium again. The ratchet-type oscillating motion is repeated until the desired position of the main step piston has been reached. Then, by continuing the adding of the hydraulic medium, the movement of the main step piston 308 for the steering angle adjustment is provided. The return movement of the step piston 308 is activated by a several axial springs 321 that push against an axial bearing carrier 322 that is connected to the step piston 308 by a groove with balls 323. During the return stroke the oil flow is directed through a return gate 324 with a check valve 325 in the rotator housing 326 to secure the possibility of returning the hydraulic medium when the circumferential hydraulic piston 317 is blocking the inlet hole 318.

Figure 4L:
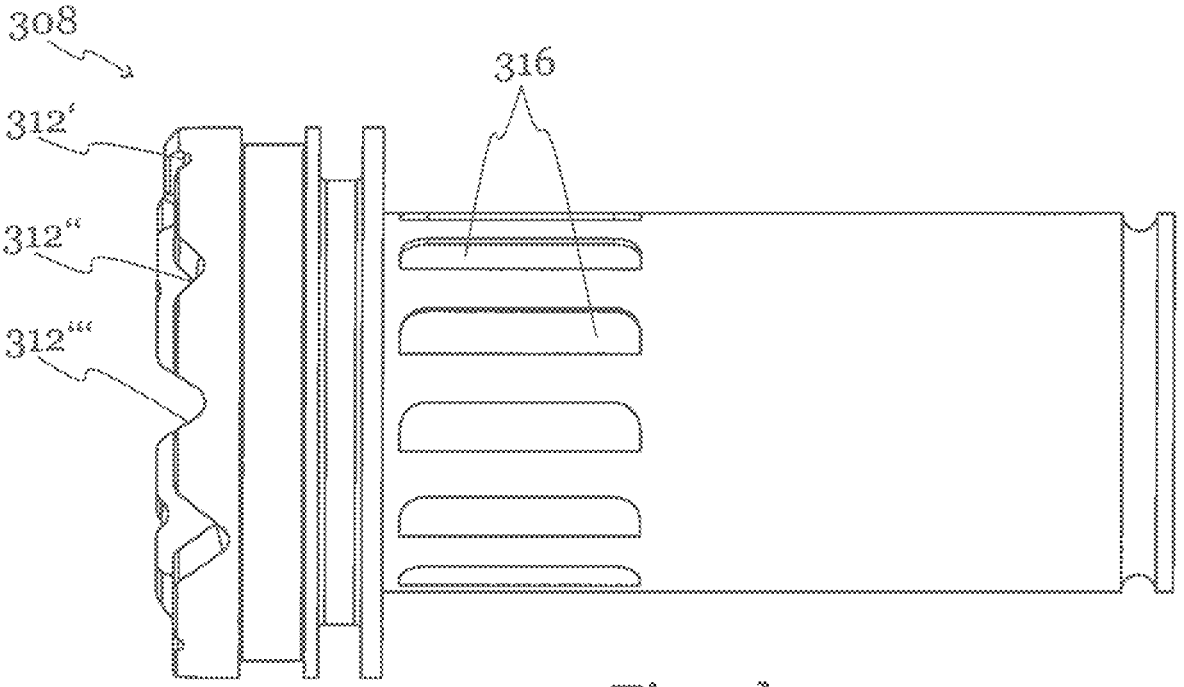
FIG. 4*l* shows a schematic side view of the step piston 308 according to the embodiment of FIG. 4*f;*
Figure 4M:
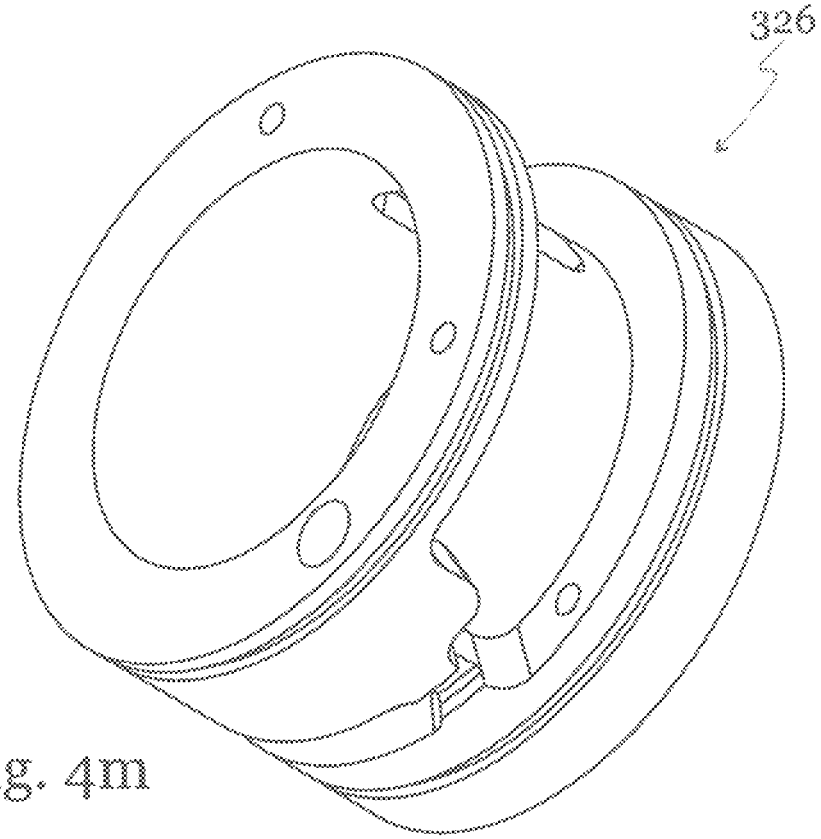
FIG. 4*m* shows a schematic view of the rotator housing.

FIG. 4*l* shows a schematic side view of the step piston 308 according to the embodiment of FIG. 4*f*. The step piston 308 comprises a shaft with axial grooves 316, in which the carrier 315 engages to rotate the step piston 308. At its face end, the step piston 308 is provided with shallow grooves 312', regular grooves 312", and deep grooves 312''', defining a steering inclination of 0°, 4°, and 8°, respectively, and placed 30° apart along the radius of the face end of the step piston 308. FIG. 4*m* shows a schematic view of the rotator housing 326, which is provided with a recess to hold the hydraulic piston 317 at its outer circumference. The recess covers only a small sector of the outer circumference of the housing 326, such as 20°-40°, and enables a movement of the hydraulic piston 317 along the circumference of the rotator housing 326. In order to introduce hydraulic medium, an inlet is provided in the side wall of the recess.

Figure 5A:
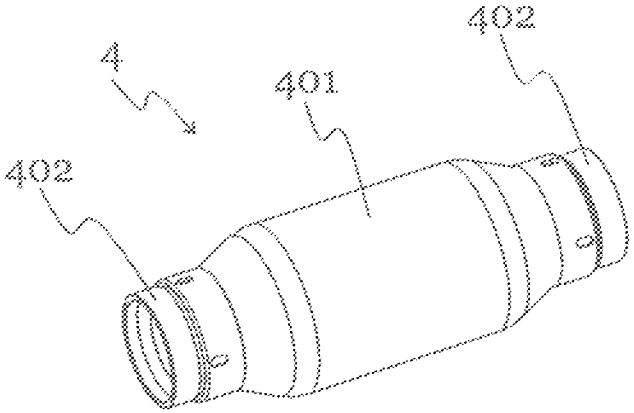
FIG. 5*a* shows a schematic view of a proposed counter hold system which allows to hold the torque of a drilling system such as the one shown in FIG. 1 during drilling.

FIG. 5*a* shows a schematic view of a proposed counter hold system 4 which allows to hold the torque of a drilling system such as the one shown in FIG. 1 during drilling. The counter hold system 4 is connectable on one end to the steering joint 3, and on the other end to a tubular member 5 which shall be pulled forward into a drilled hole. The counter hold system 4 comprises a hollow flexible bellows 401 which is clamped between two end nuts 402. The flexible bellows 401 is made of rubberlike material that allows both radial and axial expansion when an internal pressure is applied by a pressurized medium. The primary function of the counter hold system 4 is to expand radially out and thus fix parts of the drill string to the surrounding ground in order to create sufficient counter hold to the ground for both the rotation and the axial movement while drilling.

The axial movement can be provided by the bellows itself, or by an axial force providing device. The secondary function is to create a forward thrust force by allowing the flexible bellows 401 to expand axially.

Figure 5B:
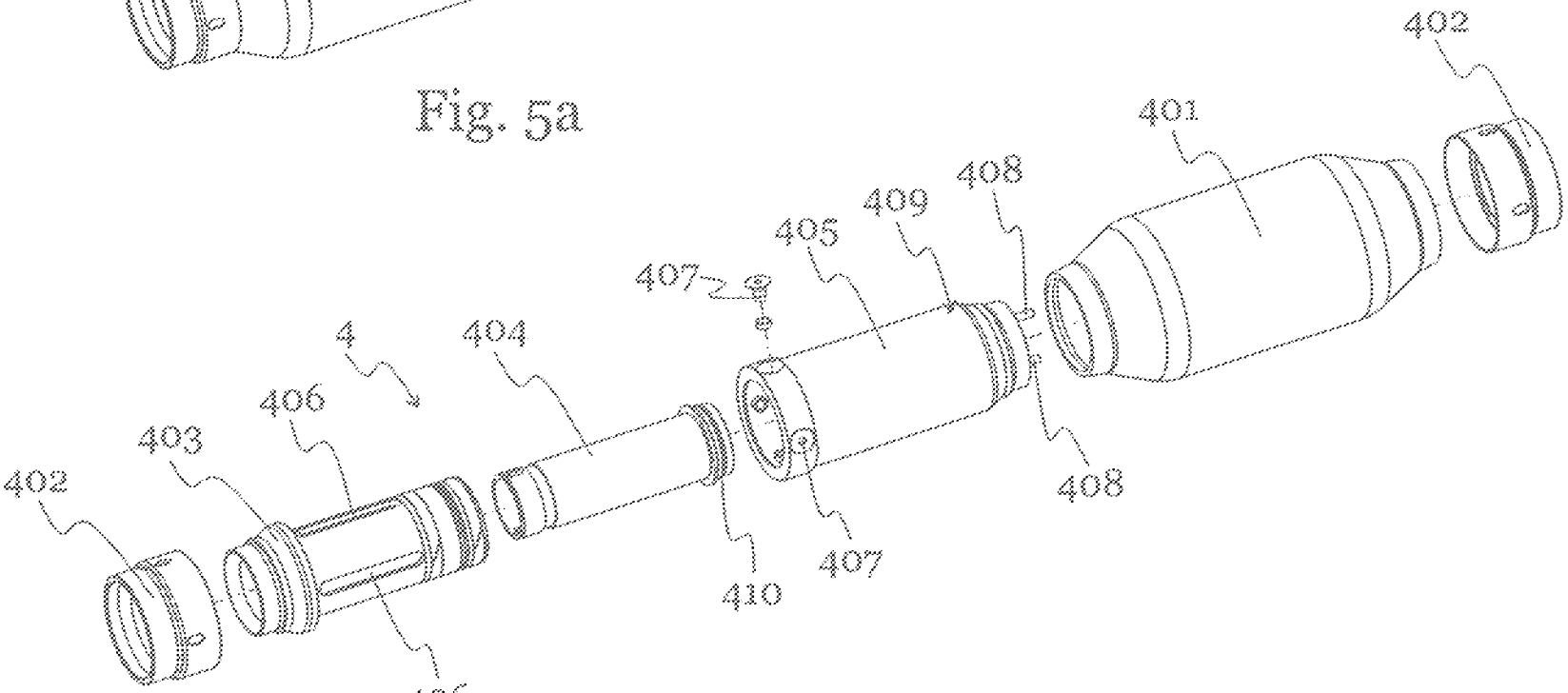
FIG. 5*b* shows a schematic explosion view of an exemplary embodiment of the counter hold system.

FIG. 5*b* shows a schematic explosion view of an exemplary embodiment of the counter hold system 4. The counter hold system 4 comprises two end nuts 402, and a flexible bellows 401 between them. Inside the flexible bellows 401 there is a cylinder body 403 with axial grooves 406 at its outer surface. The cylinder body 403 houses an axially displaceable piston 404 and is inserted into a cylinder housing 405. The piston 404 is axially movable within the cylinder body 403, and is on one end by means of a seal ring 410 connected to the cylinder housing 405. The piston 404 is hollow to allow to pass a central pipe through its center.

The flexible bellows 401 is restrained on one end to the cylinder body 403, and on the other end to the cylinder housing 405, hence the axial extension of the bellows is limited by the stroke of the piston 404 inside the cylinder body 403. Any rotation between the cylinder body 403 and the piston 404 is prevented by radial pins 407 in the cylinder housing 405 which extend and are guided in axial grooves 406 or tracks of the cylinder body 403. The cylinder housing 405 further comprises medium inlets 408 to insert pressurized medium into the flexible bellows 401 over medium outlets 409 at the outer surface of the cylinder housing 405.

Figure 5C:
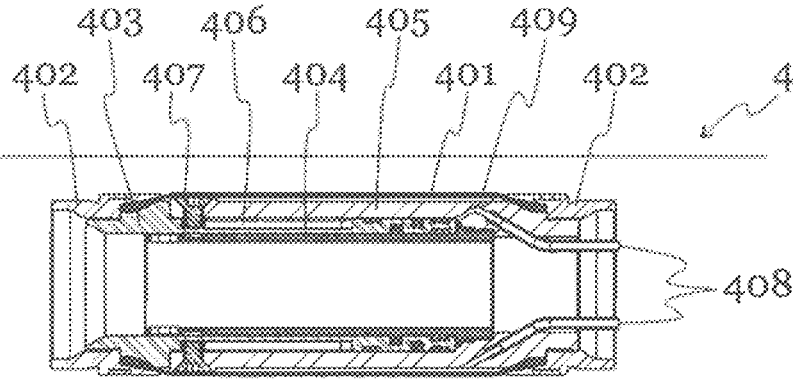
FIG. 5*c* shows the counter hold system in retracted state inside a drilled hole.
Figure 5D:
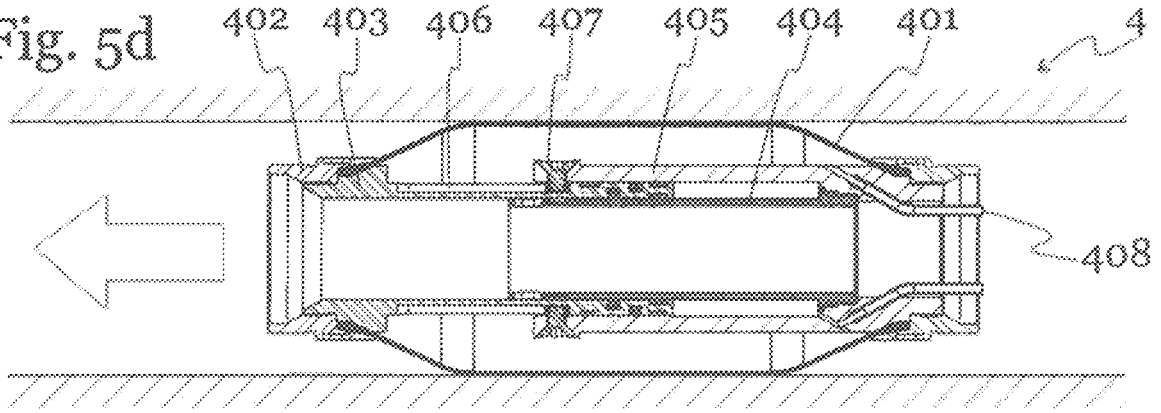
FIG. 5*d* shows the situation when the flexible bellows is pressurized by leading a pressurized medium through the medium inlets into the flexible bellows.

FIG. 5*c* shows the counter hold system 4 in retracted state inside a drilled hole. In the start position, the cylinder will stay in the shortest axial position and the bellows 401 is deflated. The flexible bellows 401 is not under pressure, and the piston 404 is driven completely into the cylinder body 403, so that the cylinder housing 405 covers the cylinder body almost completely. FIG. 5*d* shows the situation when the flexible bellows 401 is pressurized by leading a pressurized medium through the medium inlets 408 into the flexible bellows 401. The flexible bellows 401 extend first radially, until the radial extension is stopped when the flexible bellows gets in contact with the walls of the drilled hole. The radial expansion is then stopped due to the counter force from the hole walls, so that the bellows will press against the hole walls and will produce sufficient counter hold against the rotation of a front drill bit. By applying further pressure to the inside of the bellows, the bellows 401 will expand axially and push the cylinder body 403 forward.

The piston 404, which is connected to the cylinder housing 405, will remain in its position, but the cylinder body 403 will move axially until the movement is stopped when the radial pins 407 reach the end of the axial grooves 406. This axial force from the bellows 401 is sufficient to push a drill bit forward or into the ground. The force for expanding the bellows 401 is created by an external arrangement upwards in the drill assembly and can be provided by different means such as an expanding hydraulic or pneumatic piston, or an axial linear electrical actuator or a common axial force providing drilling system.

Figure 5E:
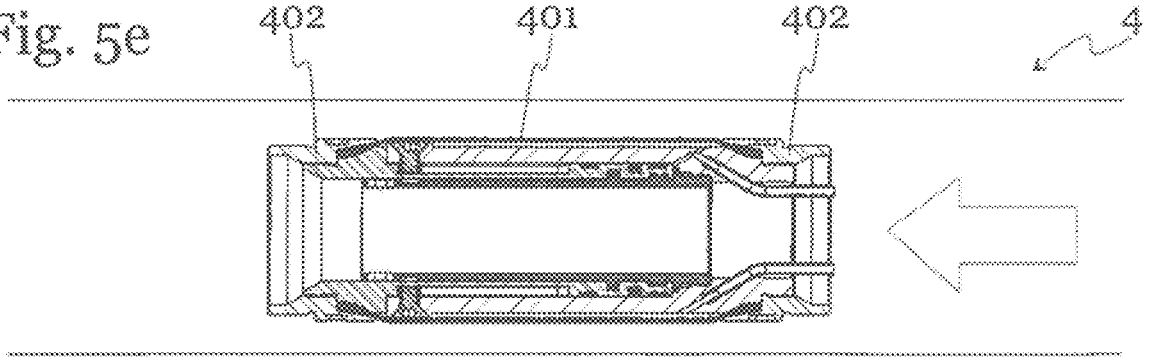
FIG. 5*e* shows the situation when the flexible bellows is evacuated again.

FIG. 5*e* shows the situation when the flexible bellows 401 is evacuated again. The bellows 401 retracts and pulls the cylinder housing 405 along the axial grooves 406 forward, so that the piston 404 is shifted forward together with the cylinder housing 405 and any tube or drill string that is connected to the end nut 402.

The negative stroke of the counter hold system can be provided by applying a negative pressure on the expanding fluid medium inside the bellows by an internal or external force providing system.

Figure 6A:
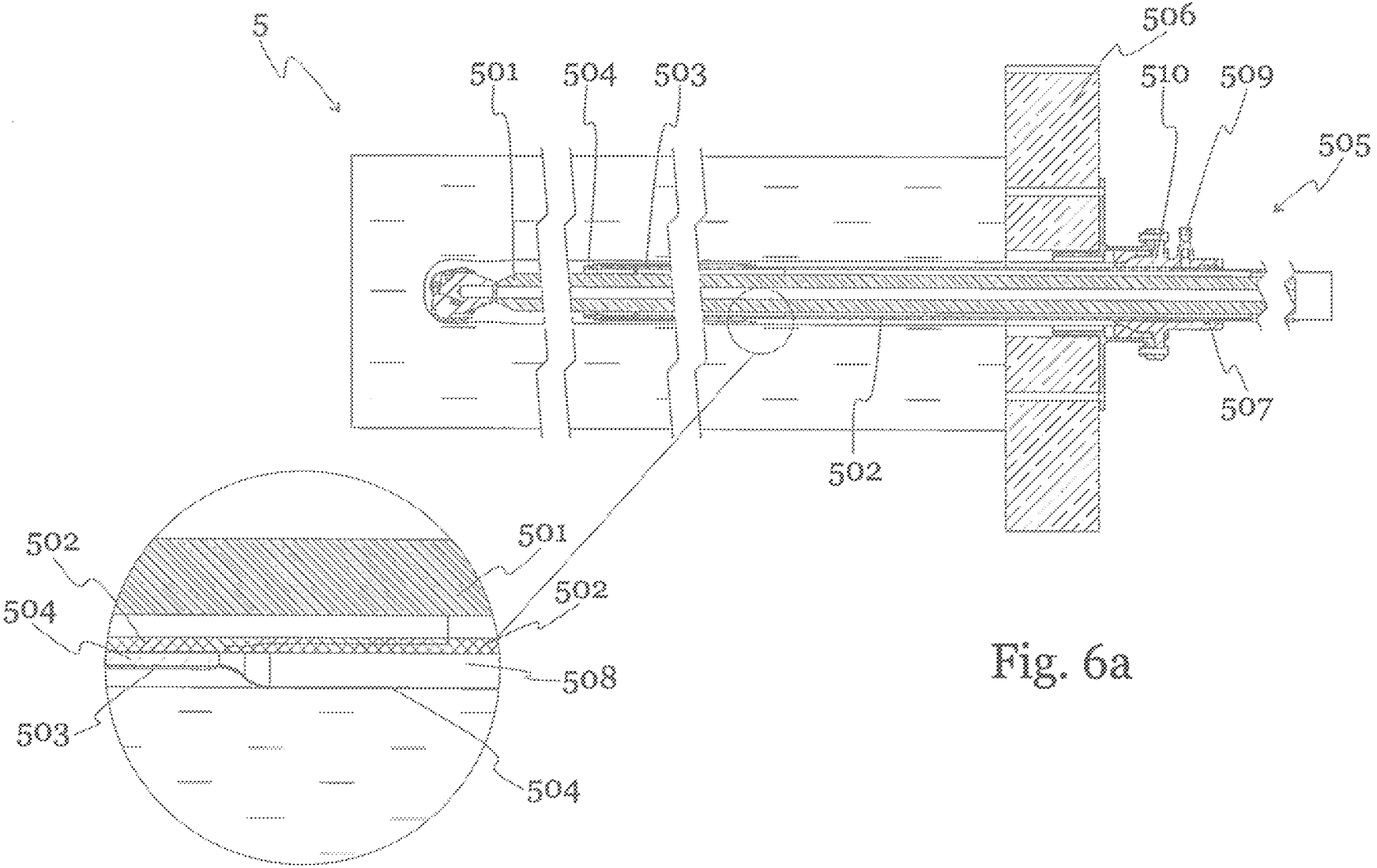
FIG. 6*a* shows a schematic view of a first embodiment of a proposed protection sleeve system, which can be applied to the tubular member of a drilling system such as the one shown in FIG. 1.

FIG. 6*a* shows a schematic view of a first embodiment of a proposed protection sleeve system 5, which can be applied to the tubular member 5 of a drilling system such as the one shown in FIG. 1. Also depicted is a drill string 501 which guides a drill head into the ground and pulls a tubular member 502 into the drilled hole. In this embodiment, a sleeve 504 is provided, which comprises a flexible braiding that allows some radial expansion, and on which a leakage safe membrane layer of rubber or plastic or a similar material is applied. The advantage of the braiding is that it allows for a higher radial expansion. The sleeve 504 is stored in an annular sleeve magazine 503 which is attached at the face end of the tubular member 502. The storage of the sleeve 504 in front end of the tubular member 502 allows it to be released or fed from the magazine 503 by the pull force which is generated by intrusion of the tubular member 502 into the ground. The sleeve is on one end attachable to the outlet flange 510 of the entrance arrangement 505 at the borehole and will cover the whole length of the tubular member 502.

The sleeve 504 is leakage safe fixed to the outer surface of the lower face end of the tubular member 502. At the entrance arrangement 505, the end of the tubular member 502 is sealed with a seal ring 507. Thus, a free and sealed space between the tubular member 502 and the sleeve 504 is formed, which builds a closed annulus chamber 508 from the end of the tubular member 502 to the entrance seal 507 on the entrance arrangement 505. By applying a pressurized fluid such as oil or air through the inlet port 509 into the annulus chamber 508, the annulus chamber 508 will be pressurized and thus radially expand. The sleeve 504 will push against the surrounding ground. Thus, a pressurized pipe in pipe system is created, that effectively reduces the friction of the tubular member 502 against the surrounding ground, so that the entering of the tubular member 502 into the ground is eased.

The detail in FIG. 6*a* shows how the sleeve 504 is stored in the sleeve magazine 503, and how the annulus chamber 508 is formed between the expanded sleeve 504 and the tubular member 502. Also shown is the drill string 501.

Figure 6B:
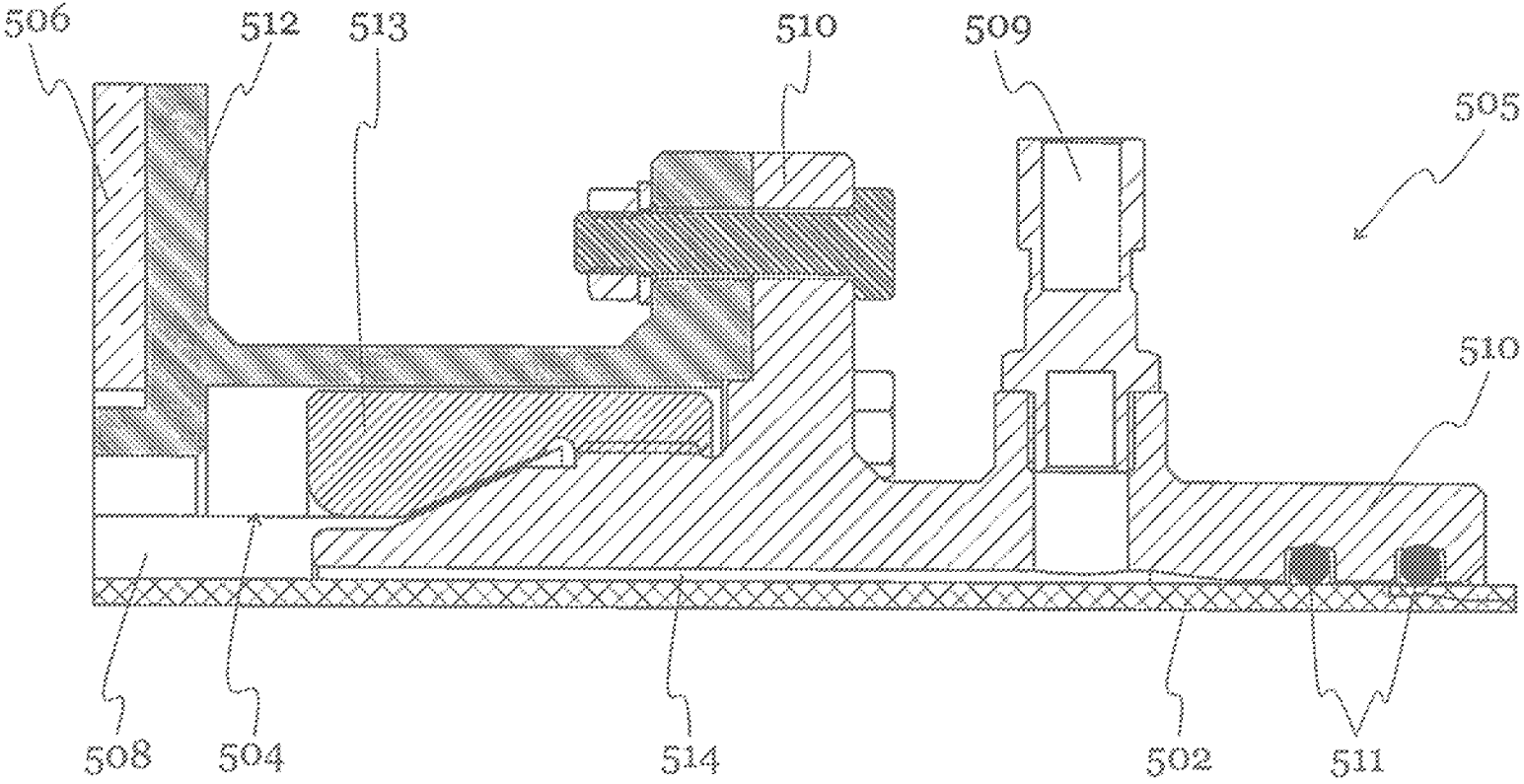
FIG. 6*b* shows a schematic cross-section view of the entrance arrangement.

FIG. 6*b* shows a schematic cross-section view of the entrance arrangement 505. The entrance arrangement 505 comprises an outlet flange 510 which is sealed around the tubular member 502 over seal rings 511. The flange 510 is connected to the hole in the wall 506 over a casing 512 which is partly introduced into the hole. A mechanical stop element 513 fastens the sleeve 504 at the flange 510, so that a tight annular chamber 508 is achieved. A thin conduit 514 between the annular chamber 508 and the port 509 enables to introduce a pressurized medium into the annular chamber 508.

Figure 6C:
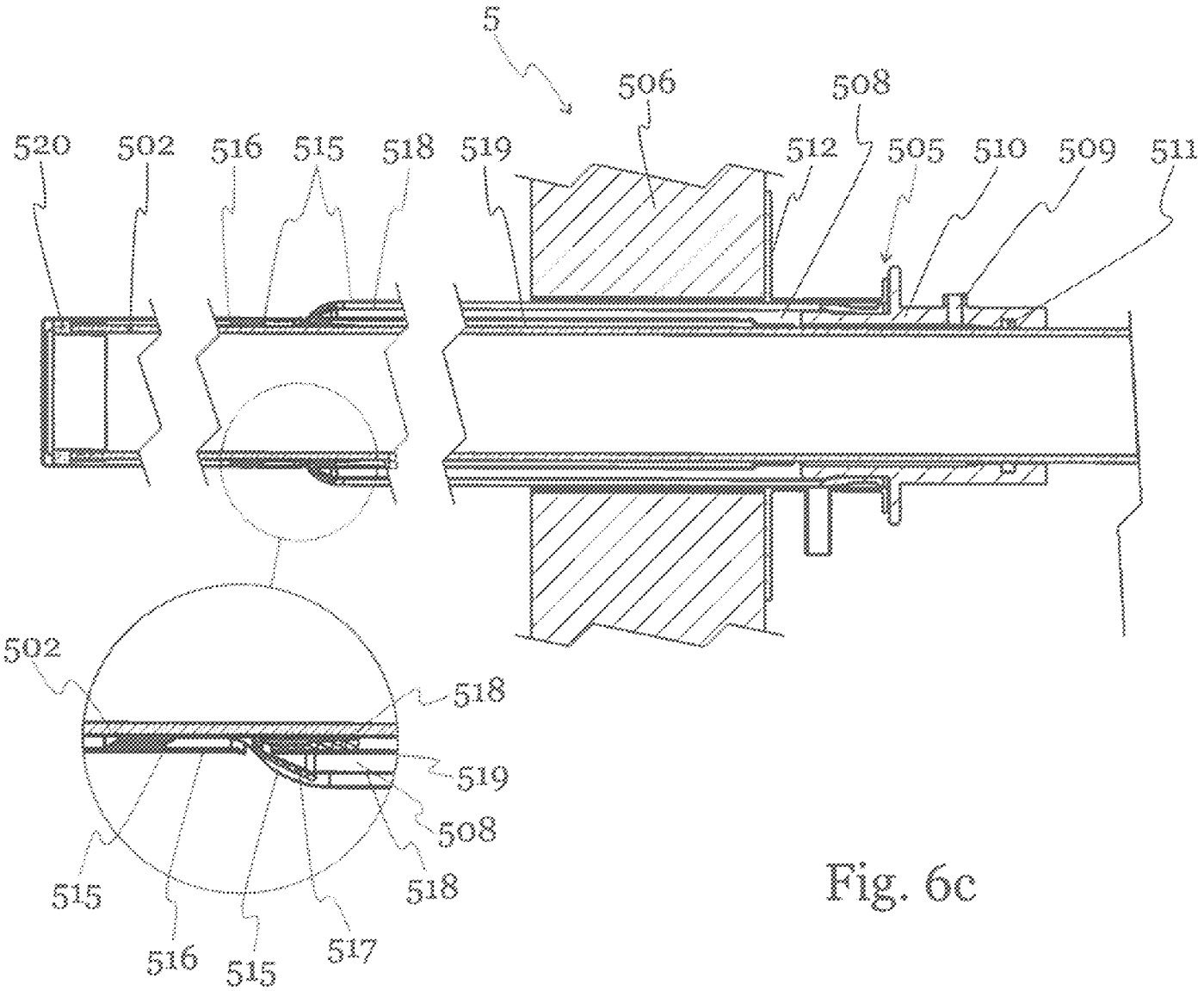
FIG. 6*c* shows a second embodiment of the protection sleeve system.

FIG. 6*c* shows a second embodiment of the protection sleeve system 5. In this embodiment, two different layers are combined to reach the desired properties. An outer structural part 515, preferably in the form of a structural braiding to achieve structural strength, is combined with an internal leakage safe member in form of a thin elastic hose 518 that rests against the inside of the structural part 515 when pressurized. In one possible arrangement, the structural part 515 and the elastic hose 518 are stored separately. An annular storage for the structural part or braiding 516 is provided at the front of the tubular member 502, and a separate annular hose storage 519 is provided on the outer surface of the tubular member 502. Both the structural part 515 and the elastic hose 518 can be fixed to the entrance arrangement 505, and thus cover the whole length of the tubular member 502. A divider 517 between the structural part 515 and the elastic hose 518 is attached to the outer surface of the tubular member 502 between the structural part storage 516 and the hose storage 519. This divider 517 separates the structural part 515 from the elastic hose 518 and prevents the elastic hose 518 to be axially displaced into and over the structural part storage 516. By applying a pressurized medium through the inlet port 509, the annular chamber 508 between the tubular member 502 and the elastic hose 518 will be pressurized and the elastic hose 518 will radially expand and force the structural part 515 to rest against the inside of the drilled hole and thus prevent the collapse of the drilled hole.

Figure 6D:
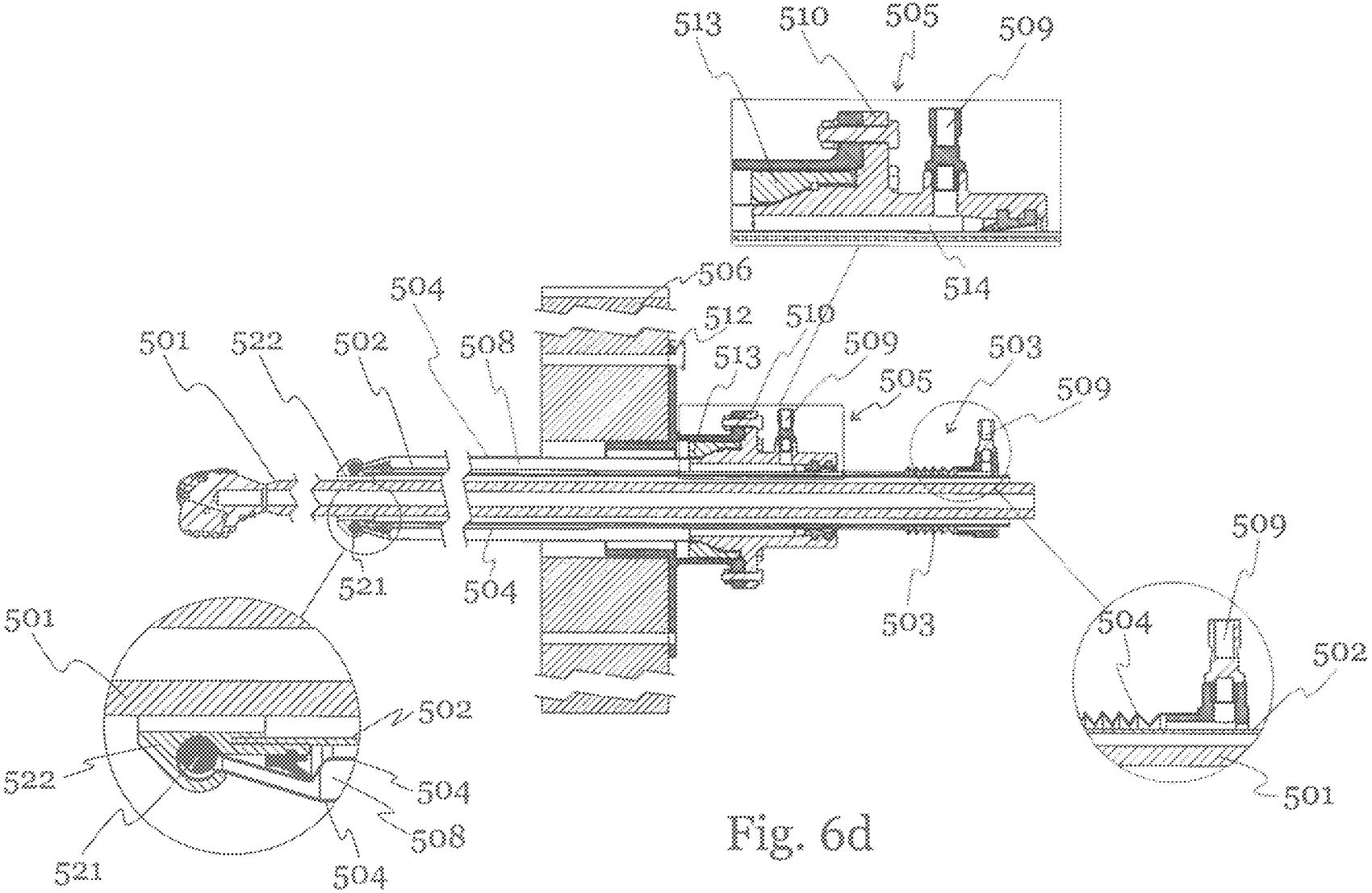
FIG. 6*d* shows a third embodiment of the protection sleeve system.

FIG. 6*d* shows a third embodiment of the protection sleeve system 5. In this embodiment, the sleeve 504 is not stored at the face end of the tubular member 502 underground, but outside of the drilled hole in a separate sleeve magazine 503 which is attached to the outside end of the tubular member 502 after the entrance arrangement 505. One end of the sleeve 504 is attached to the entrance arrangement 505, and the other end of the sleeve 504 is attached to the sleeve magazine 503.

At the end of the tubular member 502, a roller casing 522 is attached which holds a roller element 521 that turns the sleeve 504 around inside the annulus between itself and the tubular member 502 and further along the full length of the tubular member and out through the entrance arrangement 505. This embodiment provides a double sleeve system. The feeding of the sleeve during the intrusion of the pipe is done from outside in the annulus between the pipe and the outermost part of the sleeve in a separate sleeve magazine 503. The annular chamber 508 between the double laid sleeve 504 is pressurized by a fluid medium introduced through a medium inlet port 509 and thus radially expands the sleeve to rest against the ground. This pressurized sleeve conduit system creates a double-layered pipe in pipe system that effectively reduces the friction against the ground for entering the tubular member and the drill string into the ground.

Figure 7A:
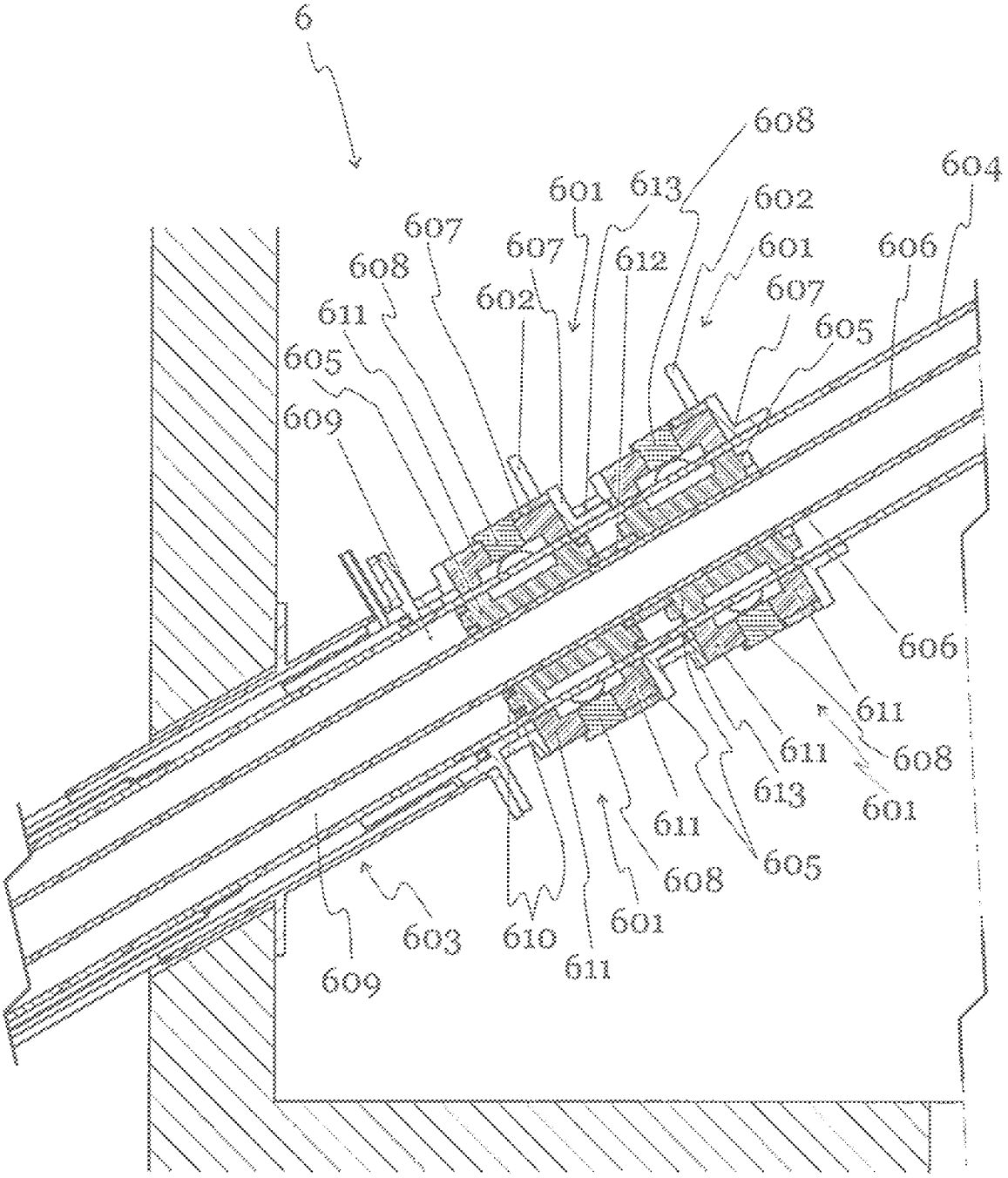
FIG. 7*a* shows a magnetic propulsion system 6 which allows to create forward thrust on a drill head assembly of a drilling arrangement such as the one shown in FIG. 1.

FIG. 7*a* shows a magnetic propulsion system 6 which allows to create forward thrust on a drill head assembly of a drilling arrangement such as the one shown in FIG. 1. The forward thrust is created by means of a magnetic source providing arrangement, particularly outer annular plugs 601 with handles 602. In alternative embodiments, other magnetic source providing arrangements can be provided, such as partially annular or rectangular magnet holders. The outer plugs 601 are movably arranged outside of the entrance arrangement 603 and encircle the tubular member 604. They can be brought in a position to create a magnetic force onto corresponding inner annular plugs 605 that are arranged inside the tubular member 604 and are movably arranged around an inner pipe 606, which might comprise supply lines to a drill head arrangement or other drill components.

The outer plugs 601 comprise a plug sleeve 607, which is rotatable around the outer circumference of the tubular member 604 and is axially shiftable by the handle 601. The plug sleeve 607 carries several magnets 608. The tubular member 604 forms together with the inner pipe 606 a hollow annular chamber 609 which is filled with a medium such as hydraulic oil. The inner annular plugs 605 are axially displaceable arranged around the inner pipe 606 and form a ring-shaped piston within the annular chamber 609. On the other end of the tubular member 604 and the inner pipe 606, these pipes are connected to the drill head arrangement or other drill system components, which enclose the annular chamber 609 tightly.

The inner annular plug 605 comprises seal rings 610 both against the tubular member 604 and against the inner pipe 606. Thus, the inside of the annular chamber 609 constitutes a closed hydraulic cylinder. The inner plugs 605 are further connected by an axial thrust coupling 612 to increase the transferable thrust. In a similar way, the outer plugs 601 are connected at their sleeves or casing 613. By pressurizing the annular chamber 609, an axial force can thus be exerted on the drill head. To put pressure on the chamber 609, the inner plug 605 can be axially displaced by the outer plug 601. The outer plug 601 is coupled to the inner plug 605 by means of a magnetic circuit.

The magnetic circuit comprises a magnet 608 such as an electromagnet or a permanent magnet, which is provided on the outer plug 601, and is embedded in a magnetically conducting material 611 such as ferromagnetic iron forming two distinct poles. On the inner plug 605, a similar magnetically conducting material is provided with correspondingly shaped poles, such that the magnetic circuit can be closed when the magnetic poles of the outer plug 601 are brought into alignment with the magnetic poles of the inner plug 605. The magnetic force is created by permanent or electrical magnets 608 arranged in a magnetically conducting material 611 in a way that allows the magnetic flux to be rotated, for instance pulled away by a plug sleeve 607 which can be manually or automatically operated by a handle 602. By rotating the handle 602, the poles of the magnetic material on the inner plug 605 and the outer plug 601 can be brought into, or out of, alignment. For this, the plug sleeve 607 to open or close the magnetic circuit between the inner plug 605 and the outer plug 601 can be electrically or manually operated in order to turn the magnetic force onto the inner plug 605 on and off. The moving of the magnets

608 thus directs or removes the coupling force between the inner plugs 605 and the outer plugs 601.

Figure 7B:
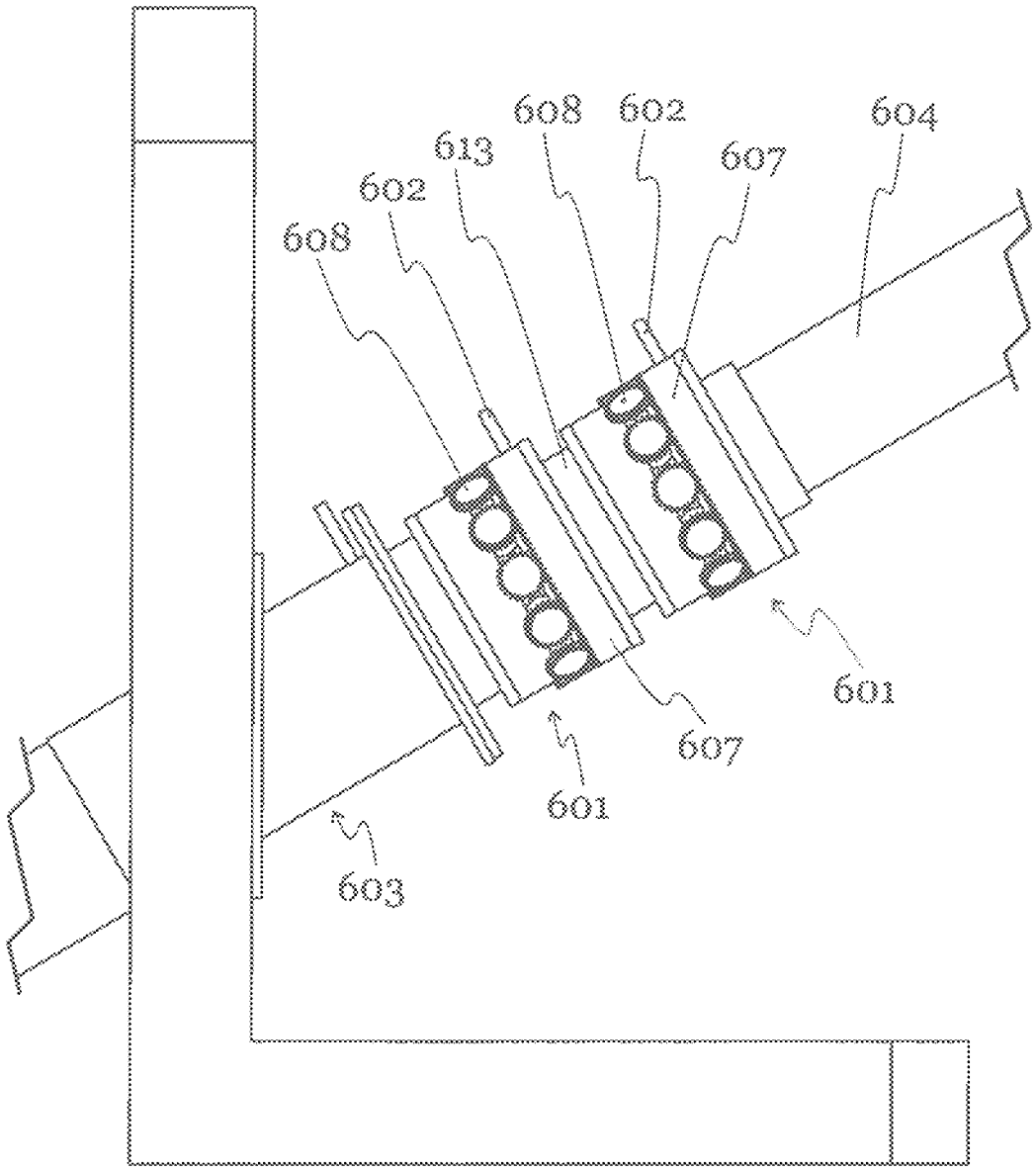
FIG. 7*b* shows a schematical view of the magnetic system from the outside.

FIG. 7*b* shows a schematical view of the magnetic system from the outside. Typically, the shape of the magnets 608 is circular with a magnetic field direction across the length axis as indicated by the arrows in the figure. In alternative embodiments, other mechanical arrangements can be chosen to displace the magnets 608 outside of the magnetic circuit of the plugs.

LIST OF NUMERALS

| | |
|---|---|
| 1 | Drill head |
| 2 | Hydraulic motor |
| 3 | Steering joint |
| 4 | counter hold system |
| 5 | Tubular member |
| 6 | Protection sleeve |
| 7 | Wall |
| 8 | Entrance arrangement |
| 9 | Central pipe |
| 10 | Hole |
| 101 | Drill bit |
| 102 | Reamer |
| 103 | Groove |
| 104 | Crushing cone |
| 105 | Hard bits |
| 106 | Shaft |
| 107 | Hollow space |
| 108 | Central pipe |
| 109 | Flushing system |
| 110 | Crushing ring |
| 201 | Motor housing |
| 202 | Rotor |
| 203 | End nut |
| 204 | Seal |
| 205 | End lid |
| 206 | Guide plate |
| 207 | Port plate |
| 208 | Vane |
| 209 | O-ring |
| 210 | Salient cam |
| 211 | Chamber |
| 212 | Inlet |
| 213 | Outlet |
| 214 | Spring |
| 215 | Track |
| 216 | Mechanical stop |
| 217 | Tip |
| 218 | Vent |
| 219 | Vane radius |
| 220 | Central inlet |
| 221 | Direction of rotation |
| 222 | Rotor |
| 223 | Pressure compensation chamber |
| 301 | Upper tubular |
| 302 | Lower tubular |
| 303 | Universal joint |
| 304 | groove tracks |
| 305 | pins |
| 306 | bearing socket |
| 307 | mechanical spring |
| 308 | step piston |
| 309 | pin keeper |
| 310 | end lid housing |
| 311 | radial cam |
| 312 | radial groove |
| 312' | shallow radial groove |
| 312" | regular radial groove |

-continued

| | |
|---|---|
| 312"' | deep radial groove |
| 313 | Counter holding pin |
| 314 | Annular flange |
| 315 | Carrier |
| 316 | Wedged tracks |
| 317 | Circumferential piston |
| 318 | Inlet hole |
| 319 | Cylinder bushing |
| 320 | Return spring |
| 321 | Axial spring |
| 322 | Axial bearing carrier |
| 323 | Groove with balls |
| 324 | Return gate |
| 325 | Check valve |
| 326 | Rotator housing |
| 401 | Flexible bellows |
| 402 | End nut |
| 403 | Cylinder body |
| 404 | Piston |
| 405 | Cylinder housing |
| 406 | Axial groove |
| 407 | Pin |
| 408 | Medium inlet |
| 409 | Medium outlet |
| 410 | Seal ring |
| 501 | Drill string |
| 502 | Tubular member |
| 503 | Sleeve magazine |
| 504 | Sleeve |
| 505 | Entrance arrangement |
| 506 | Wall |
| 507 | Seal ring |
| 508 | Annular chamber |
| 509 | Inlet port |
| 510 | Outlet flange |
| 511 | Seal ring |
| 512 | Casing |
| 513 | Stop element |
| 514 | Conduit |
| 515 | Structural part |
| 516 | Structural part storage |
| 517 | Divider |
| 518 | Elastic hose |
| 519 | Storage for hose |
| 521 | Roller element |
| 522 | Roller casing |
| 601 | Outer annular plug |
| 602 | Handle |
| 603 | Entrance arrangement |
| 604 | Tubular member |
| 605 | Inner plug |
| 606 | Inner pipe |
| 607 | Sleeve |
| 608 | Magnet |
| 609 | Annular chamber |
| 610 | Seal ring |
| 611 | Magnetically conducting material |
| 612 | Axial thrust coupling |
| 613 | Casing |

What is claimed is:

1. A hydraulic motor (2), comprising a cylindrical motor housing (201) with a central cylindrical rotor (202) carrying longitudinal vanes (208), wherein the vanes (208) are provided at the outer surface of the rotor (202) in such a manner that they can protrude into an annular space between the housing (201) and the rotor (202) in order to create a circumferential driving force on the rotor, wherein a. the housing (201) comprises inwards pointing salient cams (210) on its inner surface, which separate the annular space between the housing (201) and the rotor (202) into several hydraulic chambers (211) with at least one inlet (212) and at least one outlet (213) for a hydraulic medium, and b. the vanes (208) can swing around a longitudinal axis that is mostly parallel to the rotation axis of the rotor (202) into the hydraulic chambers (211) wherein longitudinal grooves or tracks (215) are provided on the outer end of the vanes (208), which are substantially parallel to the rotation axis of the rotor (202) in order to provide a flow resistance against medium leakage.

2. The hydraulic motor according to claim 1, wherein the at least one inlet (212) and the at least one outlet (213) are provided directly adjacent to each salient cam (210) and on opposite ends of the chamber (211), so that in any position of the rotor (202), there is at least one vane (208) provided between the at least one inlet (212) and the at least one outlet (213) of a chamber (211) in such a way that the at least one vane (208) works as a piston within the hydraulic chamber (211).

3. The hydraulic motor according to claim 1, wherein elastic elements are provided between the outer surface of the rotor (202) and each vane (208) to move the vanes (208) around their axis in radial direction outwards towards the housing (201).

4. The hydraulic motor according to claim 1, wherein the number of vanes (208) is higher than the number of salient cams (210), and the number of salient cams (210) is higher than two.

5. The hydraulic motor according to claim 3, wherein the elastic elements are provided in pressure compensation chambers (223) which are connected to the outer surface of the rotor (202) by compensation vents (218) in such a way that the radial movement of the vanes (208) is compensated with respect to the pressure difference between the at least one inlet port (212) and the at least one outlet port (213), so that the radial force on the vanes (208) is mainly provided by the elastic elements.

6. The hydraulic motor according to claim 1, wherein the vanes (208) are provided with a curved face at their rim so that, when they are folded into the rotor (202), their outer surface is substantially even with the outer cylindrical surface of the rotor (202).

7. The hydraulic motor according to claim 1, wherein a mechanical stop (216) is provided at the vanes (208) which interacts with the rotor (202) in such a way, that the vanes (208) are prevented to touch the wall of the housing (201).

8. The hydraulic motor according to claim 1, wherein the rotor (202) is hollow and comprises a substantially central opening.

9. A steerable drilling system, comprising the hydraulic motor (2) according to claim 1.

10. The steerable drilling system according to claim 9, further comprising a protection sleeve (6).

11. The steerable drilling system according to claim 9, further comprising a directional steering joint (3).

12. The steerable drilling system according to claim 9, further comprising a counter hold system (4).

13. The steerable drilling system according to claim 9, further comprising a drill head (1) with a crushing system.

14. The steerable drilling system according to claim 9, further comprising a magnetic propulsion system.

* * * * *